US012060766B2

(12) United States Patent
Ross et al.

(10) Patent No.: US 12,060,766 B2
(45) Date of Patent: Aug. 13, 2024

(54) WELL WITH PRESSURE ACTIVATED ACOUSTIC OR ELECTROMAGNETIC TRANSMITTER

(71) Applicant: METROL TECHNOLOGY LIMITED, Aberdeen (GB)

(72) Inventors: Shaun Compton Ross, Aberdeen (GB); Leslie David Jarvis, Stonehaven (GB)

(73) Assignee: METROL TECHNOLOGY LIMITED, Aberdeen (GB)

( * ) Notice: Subject to any disclaimer, the term of this patent is extended or adjusted under 35 U.S.C. 154(b) by 586 days.

(21) Appl. No.: 16/302,655

(22) PCT Filed: May 26, 2017

(86) PCT No.: PCT/GB2017/051520
§ 371 (c)(1),
(2) Date: Nov. 18, 2018

(87) PCT Pub. No.: WO2017/203290
PCT Pub. Date: Nov. 30, 2017

(65) Prior Publication Data

US 2019/0128098 A1 May 2, 2019

(30) Foreign Application Priority Data

May 26, 2016 (GB) ..... 1609288

(51) Int. Cl.
*E21B 34/06* (2006.01)
*E21B 47/06* (2012.01)
(Continued)

(52) U.S. Cl.
CPC ..... *E21B 34/066* (2013.01); *E21B 47/06* (2013.01); *E21B 47/10* (2013.01); *E21B 47/13* (2020.05);
(Continued)

(58) Field of Classification Search
CPC ..... E21B 34/066; E21B 47/13; E21B 47/06; E21B 47/14; E21B 47/18; E21B 47/07; E21B 47/10
See application file for complete search history.

(56) References Cited

U.S. PATENT DOCUMENTS 2,619,180 A 11/1952 Smith et al.
3,020,961 A 2/1962 Orr
(Continued)

FOREIGN PATENT DOCUMENTS

CN 203531888 4/2014
DE 102010014415 12/2010
(Continued)

OTHER PUBLICATIONS

UKIPO Search Report mailed Dec. 14, 2016 in corresponding GB Application No. GB1609288.4.
(Continued)

*Primary Examiner* — Tara Schimpf
*Assistant Examiner* — Neel Girish Patel
(74) *Attorney, Agent, or Firm* — Womble Bond Dickinson (US) LLP

(57) ABSTRACT

A well comprising a pressure activated device exposed to pressure in an annulus above a barrier between an upper tubular and the borehole. An acoustic or electromagnetic (EM) transmitter is coupled to the pressure activated device and configured to transmit a control signal to a respective receiver below the barrier for controlling a valve. In the event of an emergency, certain embodiments allow the pressure in the annulus to be quickly dropped, activating the transmitter to close the valve below the barrier, thus isolating the well below the barrier. A variety of default states may be programmed into the transmitter, such as transmitting a 'stay-open' signal to the receiver controlling the valve,
(Continued)

which is configured to close if this signal is not received. A further EM or acoustic transmitter may be coupled to the valve to send information from below the barrier to above the barrier, such as pressure data or valve status.

27 Claims, 8 Drawing Sheets

(51) Int. Cl.

| | |
|---|---|
| ***E21B 47/07*** | (2012.01) |
| ***E21B 47/10*** | (2012.01) |
| ***E21B 47/13*** | (2012.01) |
| ***E21B 47/14*** | (2006.01) |
| ***E21B 47/18*** | (2012.01) |

(52) U.S. Cl.
CPC ..... *E21B 47/14* (2013.01); *E21B 47/18* (2013.01); *E21B 47/07* (2020.05)

(56) References Cited

U.S. PATENT DOCUMENTS

| | | | | |
|---|---|---|---|---|
| 5,273,112 | A | 12/1993 | Schultz | |
| 5,394,141 | A | 2/1995 | Soulier | |
| 5,576,703 | A | 11/1996 | MacLeod et al. | |
| 5,704,426 | A * | 1/1998 | Rytlewski | E21B 43/14 175/4.52 |
| 6,131,462 | A | 10/2000 | EerNisse et al. | |
| 6,173,772 | B1 | 1/2001 | Vaynshteyn | |
| 6,302,216 | B1 | 10/2001 | Patel | |
| 6,357,525 | B1 | 3/2002 | Langseth et al. | |
| 6,494,616 | B1 | 12/2002 | Tokhtuev et al. | |
| 7,004,252 | B2 | 2/2006 | Vise, Jr. | |
| 8,215,164 | B1 | 7/2012 | Hussain et al. | |
| 8,517,113 | B2 | 8/2013 | Sheffield | |
| 2002/0020535 | A1 * | 2/2002 | Johnson | E21B 37/08 166/278 |
| 2002/0066563 | A1 * | 6/2002 | Langseth | E21B 49/08 166/264 |
| 2003/0056952 | A1 | 3/2003 | Stegemeier et al. | |
| 2004/0104029 | A1 | 6/2004 | Martin | |
| 2005/0077086 | A1 | 4/2005 | Vise | |
| 2006/0225881 | A1 * | 10/2006 | O'Shaughnessy | E21B 47/07 166/250.07 |
| 2007/0162235 | A1 | 7/2007 | Zhan et al. | |
| 2007/0236215 | A1 | 10/2007 | Innes et al. | |
| 2008/0066536 | A1 | 3/2008 | Goodwin et al. | |
| 2008/0156482 | A1 | 7/2008 | Gubar et al. | |
| 2009/0229813 | A1 | 9/2009 | Brink et al. | |
| 2009/0290328 | A1 | 11/2009 | Ueyama | |
| 2010/0314174 | A1 * | 12/2010 | Denoix | E21B 21/103 175/57 |
| 2011/0158050 | A1 | 6/2011 | Merino et al. | |
| 2011/0174487 | A1 | 7/2011 | Burleson et al. | |
| 2011/0303409 | A1 | 12/2011 | Harrigan et al. | |
| 2012/0085540 | A1 | 4/2012 | Heijnen | |
| 2013/0008648 | A1 * | 1/2013 | Lovorn | E21B 21/103 166/250.01 |
| 2013/0075109 | A1 | 3/2013 | Frisby et al. | |
| 2013/0128697 | A1 | 5/2013 | Contant | |
| 2013/0133883 | A1 | 5/2013 | Hill | |
| 2013/0299165 | A1 | 11/2013 | Crow | |
| 2014/0041873 | A1 | 2/2014 | Lovik | |
| 2014/0311736 | A1 | 10/2014 | Pipchuk et al. | |
| 2014/0338896 | A1 * | 11/2014 | McGarian | E21B 47/005 166/250.08 |
| 2015/0159480 | A1 | 6/2015 | Kalyanaraman et al. | |
| 2015/0167442 | A1 * | 6/2015 | Harfoushian | E21B 43/267 166/264 |
| 2015/0233773 | A1 | 8/2015 | Sale et al. | |
| 2015/0292288 | A1 | 10/2015 | Kasperski et al. | |
| 2015/0315895 | A1 | 11/2015 | Patel et al. | |
| 2016/0123133 | A1 | 5/2016 | Leeflang et al. | |
| 2016/0168985 | A1 * | 6/2016 | Betancourt-Pocaterra | E21B 49/005 73/152.04 |
| 2016/0265350 | A1 * | 9/2016 | Brown-Kerr | E21B 47/22 |
| 2018/0094495 | A1 * | 4/2018 | Wardley | E21B 23/04 |

FOREIGN PATENT DOCUMENTS

| | | | | |
|---|---|---|---|---|
| EP | 2192262 | | 6/2010 | |
| EP | 2886790 | | 6/2015 | |
| EP | 3464801 | | 3/2020 | |
| GB | 2522272 | | 7/2015 | |
| GB | 2522272 | A * | 7/2015 | E21B 34/06 |
| WO | 99/31351 | | 6/1999 | |
| WO | 200301169 | | 1/2003 | |
| WO | 2003098176 | | 11/2003 | |
| WO | 2011/090698 | | 7/2011 | |
| WO | 2014022384 | | 2/2014 | |
| WO | 2014120988 | | 8/2014 | |
| WO | 2017203285 | | 11/2017 | |
| WO | 2017203286 | | 11/2017 | |
| WO | 2017203287 | | 11/2017 | |
| WO | 2017203288 | | 11/2017 | |
| WO | 2017203291 | | 11/2017 | |
| WO | 2017203292 | | 11/2017 | |
| WO | 2017203293 | | 11/2017 | |
| WO | 2017203294 | | 11/2017 | |
| WO | 2017203295 | | 11/2017 | |
| WO | 2017203296 | | 11/2017 | |

OTHER PUBLICATIONS

International Search Report for PCT/GB2017/051520, Jul. 24, 2017.
Schlumberger: "WellWatcher Flux, Multizonal reservoir monitoring system", 2016.
Copending International Application No. PCT/GB2017/051515 filed May 26, 2017.
Copending International Application No. PCT/GB2017/051516 filed May 26, 2017.
Copending International Application No. PCT/GB2017/051517 filed May 26, 2017.
Copending International Application No. PCT/GB2017/051518 filed May 26, 2017.
Copending International Application No. PCT/GB2017/051521 filed May 26, 2017.
Copending International Application No. PCT/GB2017/051522 filed May 26, 2017.
Copending International Application No. PCT/GB2017/051523 filed May 26, 2017.
Copending International Application No. PCT/GB2017/051524 filed May 26, 2017.
Copending International Application No. PCT/GB2017/051525 filed May 26, 2017.
Copending International Application No. PCT/GB2017/051526 filed May 26, 2017.
International Preliminary Report on Patentability for PCT/GB2017/051520, Apr. 24, 2018.
Examination Report for Corresponding Eurasian Application No. 201892717, Nov. 20, 2020.
Examination Report for Corresponding Eurasian Application No. 201892717, Apr. 15, 2020.
Examination and Search Report for Malaysian Application No. PI 2018002068, Oct. 27, 2021.
Examination Report on Australian Application 2017271008, Nov. 24, 2021.
Examination Report for Corresponding Eurasian Application No. 201892717, Sep. 13, 2021.

* cited by examiner

WELL WITH PRESSURE ACTIVATED ACOUSTIC OR ELECTROMAGNETIC TRANSMITTER

CROSS REFERENCE TO RELATED APPLICATIONS

This application is a 35 U.S.C. 371 National Stage of International Application No. PCT/GB2017/051520, titled "WELL WITH PRESSURE ACTIVATED ACOUSTIC OR ELECTROMAGNETIC TRANSMITTER", filed May 26, 2017, which claims priority to GB Application No. 1609288.4, titled "WELL", filed May 26, 2016, all of which are incorporated by reference herein in their entirety.

This invention relates to a well with a well apparatus for improving the speed of response of a wireless valve in the well during operations such as testing, and/or improving the safety of the well.

Wells are drilled for a variety of purposes commonly relating to hydrocarbon exploration or extraction.

Valves may be provided in a well for testing. Moreover, in a production or injection well, fluids flow into (or from) a well below a packer, and are then recovered (or injected) through a central tubing. A sub-surface safety valve is normally provided, towards the top of the well, which can be closed in the event of an emergency. On occasion, the well can be shut down for maintenance or other purposes, and some useful data can be inferred regarding the reservoir, depending on the reservoir response when the well is shut in.

Valves may be provided below the packer, and the valves can be controlled from surface using acoustic signals or electromagnetic (EM) signals. Whilst generally effective, the inventors of the present invention note that there is often an element of delay for these signals to travel from surface to the valve. Long range, in well wireless telemetry, typically utilizes low data rate communication, typically less than 40 baud, and sometimes less than 1 baud and may be further slowed by the requirement for multiple repeaters to relay the communication. The inventors of the present invention have noted that this element of delay may be critical, especially when operation of the valve is required for safety reasons or in an emergency.

Furthermore the inventors of the present invention have noted that in certain applications the provision of acoustic or electromagnetic telemetry from surface may not be feasible due to well design constraints, such as repeaters restricting well access or flow, or due to prohibitive cost.

According to a first aspect of the present invention, there is provided a well comprising:

a borehole with an upper tubular and a lower tubular therein, each tubular having a longitudinal bore; and, a well apparatus, the well apparatus comprising:

an annular barrier provided between one of the borehole and a casing within the borehole, and one of the upper and lower tubulars, such that the upper tubular extends from and above the annular barrier such that an annular space above the annular barrier is provided between the upper tubular and the borehole, and the lower tubular is provided in the borehole below the annular barrier;

a pressure activated device exposed to pressure between the upper tubular and the borehole and adapted to detect a characteristic change in pressure;

an electronic transmitter above the annular barrier and coupled to the pressure activated device, and configured to transmit a control signal;

a flowpath through at least one of the longitudinal bore of the lower tubular and a port in the lower tubular;

a valve connected to the lower tubular, the valve configured to allow or resist flow of fluids through said flowpath;

an electronic control mechanism below the annular barrier to control the valve, the electronic control mechanism comprising a communication device with a receiver configured to receive the control signal from the electronic transmitter for operating the valve;

wherein the electronic transmitter and the receiver comprise an acoustic transmitter and receiver or an electromagnetic transmitter and receiver.

Thus the valve connected to the lower tubular, which is below the annular barrier, may be controlled by a characteristic change in pressure in an annular space above the annular barrier. This can provide a far quicker response to a signal compared to using other forms of wireless transmission. Moreover, should the well rupture in any way, the loss of pressure in the annulus caused by the rupture can be a characteristic change in pressure and so the well apparatus can be, for example, configured such that the valve automatically closes. Thus embodiments provide a quick safety-shutdown mechanism, suitable for use in emergency situations, caused by, for example, a loss in well integrity.

A further advantage is that the invention provides a stand-alone alternative, or redundancy option, to electromagnetic or acoustic communications. For embodiments using stand-alone pressure communication from surface, this can avoid the expense, or eliminate compromises on well architecture associated with acoustic and EM communication.

The valve normally controls flow through or into the lower tubular, and therefore flow through the upper tubular.

The characteristic change in pressure normally comprises a drop in pressure, though increases in pressure may also be used, for example in pressure key sequencing which may use a series of increases and decreases in pressure.

Acoustic and/or electromagnetic signals sent over the relatively short distance between the electronic transmitter and receiver may be sent at higher baud rates, and with less, or no repeaters when compared with sending similar signals from surface.

In use, the characteristic change in pressure normally travels a long distance, typically from surface, such as at least 100 m, more than 500 m, more than 1000 m or more than 2000 m; though this can vary with, for example, the length of the particular well and the position of the pressure activated device.

An advantage of certain embodiments is that closing a valve in a tubular below the annular barrier can isolate a particular section of the well infrastructure. For example, in certain embodiments, the upper tubular is sealed to the annular barrier often by a dynamic seal. This can be isolated by closing the valve in the lower tubular below the annular barrier.

Modes

The well apparatus can take on one, or various modes of operation, such as an opening mode, a closing mode, and a master control mode where a master control signal controls the valve.

Normally the modes are programmed into a device proximate the valve below the barrier or proximate the transmitter above the barrier. The modes may be programmed into the electronic control mechanism, or alternatively a suitable device above the annular barrier.

A positive signal may be sent from the transmitter to the receiver, in response to the characteristic change in pressure, to instruct the valve to take certain action. In a closing mode, the at least one transmitter may be configured to send a signal to instruct the valve to resist flow of fluids through said flowpath. In an opening mode, it may be configured to send a signal to instruct the valve to allow flow of fluids through said flowpath.

For embodiments where the characteristic change in pressure is a pressure drop, the closing mode is a failsafe mode. A well test mode is normally a failsafe mode.

Additionally or alternatively, the transmitter may be configured to periodically send a default signal to the receiver, unless a characteristic change in pressure is detected. In a default mode, and in the absence of the receiver receiving said periodic default signal for a specified period of time, the valve may be biased (via programming) to either resist flow or to allow flow through the flowpath. Thus the default signal may be an "allow flow" or a "resist flow" signal and in the absence of receiving this signal, the well apparatus is configured to cause the valve to resist flow or allow flow respectively. The time between signals of the default signal can be varied, especially depending on any operations being performed on the well. For example, the default signal may be transmitted continuously, or every 10 seconds, or may be up to every hour or more. More frequent default signals are more often used with well tests, whilst less frequent default signals are more often used for production or injection wells and completions. This can also facilitate a "sleep mode" where the transmitter sends a signal (or the receiver listens for a signal) less frequently, during certain operations. This can save on battery power.

A simple characteristic pressure change may be used especially when the valve/system is in the closing or opening mode, and more complex/multi-step coded pressure pulses may be used especially to control or change the valve mode.

The valve is thus electronically controlled by the signal via the electronic control system, which instructs it to, for example, allow or resist fluid flow. The valve may then use any appropriate means to actuate between various positions by using, for example, a spring, a pressure release mechanism or a motor driven screw. Thus the valve may be mechanically biased. The resist flow position is often a stop flow or closed position.

The valve may be operable as a downhole flow control valve in a drill stem test apparatus, often functioning akin to a tester valve except below the annular barrier. Normally this would be operated in a default (or failsafe)-close mode. That is the transmitter would transmit a periodic "allow flow signal" unless it detects a characteristic change in pressure. If the receiver does not receive this signal for any reason, a component of the well apparatus, such as the electronic control mechanism, is programmed to bias the valve to resist flow. The valve may also be mechanically biased towards a particular position. However, especially where there are a plurality of valves below the annular barrier, a default-open mode may also be adopted. At other times, it is also normal to be locked open or locked shut, that is controlled by a master control signal, in preference to any signal received from the transmitter.

Therefore, for certain embodiments, the valve will close (or open) within 5 minutes, or within 4 minutes, optionally 3 or 2 minutes or indeed within a minute after the characteristic change in pressure.

Especially for initial set up, master control signals may be sent from a transmitter at the surface optionally using relays as disclosed herein. EM or acoustic signals (and where available inductively coupled tubulars) are preferred compared to coded pressure pulses, as they can be independent of other operations and confirmation signals of instructions to well tools can be returned.

The well apparatus may also have a failure mode, to set the valve to an open or closed position in the event of a failure of the power system or a low/inoperable battery. In some circumstances this will be a mechanical bias, but such a failure mode may also or alternatively be programmed into a suitable device (or for example the electronic control mechanism) and activated, for example, if the battery is assessed as close to losing power.

The preferred failure mode may indeed be different to the default mode. For example, in a failure mode the well apparatus may cause the valve to open in order to provide the opportunity to kill the well by conventional means; whilst in a default mode, it may be configured to close.

The different modes of operation are not necessarily restricted to different embodiments. For example, one embodiment can function in a default closed mode and then be instructed to operate in a default open mode.

Wells

The pressure activated device is exposed to pressure between the upper tubular and the borehole and may be positioned above the annular barrier, such as at most 1000m, optionally at most 500m, optionally at most 100m or optionally at most 50m or at most 10m above the annular barrier.

Thus embodiments of the well apparatus may be used in exploration, appraisal or development wells, where well testing often takes place. In alternative embodiments, the well apparatus may be in any other well such as a production well (active or suspended) or an injection well. Whilst various modes can be adopted, the default-open mode can be particularly useful for such embodiments. This ensures that a production well is not unintentionally shut due to loss of signals. In production wells, a separate sub-surface safety valve is normally provided above the annular barrier (normally less than 500m, often less than 100m from a surface of the well) which can be shut in an emergency. Thus the counter-intuitive default-open mode may be adopted for the valve below the annular barrier.

In alternative embodiments, the valve may operate in a default close mode for a production well, and so provide a back-up, or alternative, to the normally installed sub-surface safety valve above the annular barrier. These features of operating as a back-up or alternative sub-surface safety valve can be advantageous for production well operators, as in a back-up mode the apparatus would enable production to continue from the well if the normal sub-surface safety valve fails. Regulations generally state that in a production completion, if the (normal) sub-surface valve fails its tests or fails to operate, then the well has to be shut in until such time as the valve can be replaced. In some instances this may involve a very expensive rig operation to work over the well and may take several days, weeks or months to do so. During such time the operator of the well will suffer lost production from the well which can be very expensive.

This contrasts sharply with traditional sub-surface safety valves which are hydraulically operated and there is a disincentive to provide redundancy, especially for subsea wells, because the additional hydraulic control lines may require porting on trees which create additional potential leak paths. Thus only essential lines are run from the surface/subsea location to subsurface devices. In contrast, embodiments of the invention use wireless communications and so do not suffer from potential leak paths. Moreover, the valve can protect the entire string above the annular barrier without running long control lines. Furthermore, for certain embodiments, because the apparatus can communicate with multiple valves below the packer(s), if there is a safety issue with an individual section, then the apparatus can send a signal to a specific valve and isolate that section. This may allow production from zones adjacent other sections to continue until the issue is resolved. Again, this may be financially beneficial to the operator as in this scenario the full production well may not have to be shut-in.

Embodiments may include a device which monitors parameters which are indicative of flow rate through the valve, to try to detect abnormally high flow rate (indicative of uncontrolled flow) and resist flow of fluids if this is detected. Other factors may also be taken into account in assessing whether uncontrolled flow is occurring. The valve may be adapted (by programming) to resist flow of fluids if the device monitors that a pre-determined flow rate is exceeded. The pre-determined flow rate is settable and variable downhole. Such a device may be a differential pressure gauge across a restriction.

In a master control mode, the valve may be configured to allow or resist fluid flow in response to a master control signal, in preference to said signal from the transmitter. The master control signal can be transmitted from surface, optionally via relays, or from within the well.

Thus in a production well in one phase, such as during deployment, the valve is controlled by a master control mode, preferably via EM and/or acoustic signals in preference to said signal from the transmitter i.e. independent of the pressure between the upper tubular and the borehole. In a second phase, such as during production, the well apparatus is in a different mode, such as a default-open mode, which is dependent on pressure between the upper tubular and the borehole. The first and second phases could also be other phases such as early production and later production life.

Pressure Activated Device

The pressure activated device may comprise a pressure sensor. It may be physically or wirelessly coupled to the transmitter.

The characteristic change in pressure is a change in pressure which is distinguishable from the changes in pressure expected during normal operations. It may be a trigger point where consequential action is taken, for example, shutting the valve.

Many examples of characteristic change in pressure may be used, such as a proportional or absolute change in pressure, or a pressure change by a certain magnitude; optionally also dependent on the time taken for such a change. The characteristic change in pressure is often a drop in pressure. However, for certain embodiments the characteristic change in pressure may be an increase in pressure especially due to pressure cycling, where the pressure increases and optionally decreases, or vice versa, over a period of time. The pressure cycles may be a pre-determined "key" sequence to provide a control signal to control a pressure activated device. Information may be encoded by the timing and/or the magnitude of the pressure changes.

It may be absolute or relative change, for example if the change in pressure is more than 500 psi or more than 1000 psi; or, if the change in pressure is more than 20% or more than 30% or more than 40% change in the absolute pressure. It may be a pressure difference optionally including the rate of change. For example, it may be at least 100 psi or at least 500 psi, or at least 1000 psi; optionally over a period of up to 1 minute, more optionally up to 5 minutes, even more optionally up to 1 hour. Longer term changes in pressure are less likely to be indicative of a leak and may be, for example, due to fluid movement in the well from deeper/warmer areas causing a temperature increase which raises pressure. In particular the characteristic change in pressure may also include a more specific, much sharper rate of change in pressure, for example a sudden change of pressure is more indicative of an emergency.

Indeed, the pressure changes may be less than 750 psi, or less than 500 psi, or less than 250 psi. Thus an advantage of such embodiments is that more subtle pressure changes can be used to control the valve in the well apparatus.

Thus, the characteristic change in pressure may be a single change in pressure, for example a drop in pressure, rather than a more complex change, such as more than one change in pressure, or more than five changes in pressure. Such more complex changes often relate to more complex coded pressure pulses. Thus the characteristic change in pressure does not necessarily rely on time between separate pressure changes.

It may also include where the change passes a specified pressure threshold, especially where it drops below a specified pressure threshold. For example the characteristic change in pressure may be if the pressure drops below 2000 psi, or 1500 psi or 1000 psi.

The characteristic change in pressure may also be varied depending on downhole parameters. For example, if the surrounding temperature is higher, then a higher pressure change or pressure could be tolerated before being considered a characteristic change in pressure. Thus the well apparatus can adapt the characteristic change in pressure whilst in situ. Other parameters may also be used, including earlier pressure readings.

The characteristic change in pressure may be pre-programed before running in-hole or indeed may be settable and variable downhole. For example a signal may be sent by pressure sequence and/or, optionally via wireless means, to set or vary a trip point (however determined) where the well apparatus considers this a characteristic change in pressure. A wireline or tubing conveyed probe may be used and transmit instructions by such means or for example, via inductive coupling. This can be useful when certain operations are conducted on the well. For example, at certain stages during a well test or production operations, different pressures can be expected in the annular space, due to, for example, thermal expansion. Thus the trip point may be higher where more, or larger, pressure changes are expected. Then optionally the trip point can be changed back, in situ, when less or smaller pressure changes are expected. The frequency that the receiver/valve expects to receive a default signal can similarly be varied in situ.

Pressure pulses include methods of communicating from/to within the well/borehole, from/to at least one of a further location within the well/borehole, and the surface of the well/borehole, using positive and/or negative pressure changes, and/or flow rate changes of a fluid in a tubular and/or annular space.

Coded pressure pulses are such pressure pulses where a modulation scheme has been used to encode commands and/or data within the pressure or flow rate variations and a transducer is used within the well/borehole to detect and/or generate the variations, and/or an electronic system is used within the well/borehole to encode and/or decode commands and/or the data. Therefore, pressure pulses used with an in-well/borehole electronic interface are herein defined as coded pressure pulses. An advantage of coded pressure pulses, as defined herein, is that they can be sent to electronic interfaces and may provide greater data rate and/or bandwidth than pressure pulses sent to mechanical interfaces.

The pressure activated device is normally an electronic device providing an electronic interface. Therefore, at least by virtue of the electronic interface, the characteristic change in pressure is normally a coded pressure pulse as described herein.

Coded Pressure Pulses

The coded pressure pulse(s) used to activate the pressure activated device, may use various modulation schemes to encode control signals such as a pressure change or rate of pressure change, on/off keyed (OOK), pulse position modulation (PPM), pulse width modulation (PWM), frequency shift keying (FSK), pressure shift keying (PSK), amplitude shift keying (ASK), combinations of modulation schemes may also be used, for example, OOK-PPM-PWM. Data rates for coded pressure modulation schemes are generally low, typically less than 10 bps, and may be less than 0.1 bps.

Coded pressure pulses can be induced in static or flowing fluids and may be detected by directly or indirectly measuring changes in pressure and/or flow rate. Fluids include liquids, gasses and multiphase fluids, and may be static control fluids, and/or fluids being produced from or injected into the well.

Well Infrastructure

The upper tubular may be the innermost tubular of adjacent tubulars in the well apparatus. For example a well often comprises a plurality of tubulars, such as casing strings and a production tubular or DST string. Taking a cross section of tubulars including the upper tubular, it is normally the innermost tubular of such a cross section.

The pressure in at least a portion of the annular space is normally controllable from outwith the well. The annular barrier may have an inner bore and the upper tubular may extend from within the inner bore above the annular barrier.

The borehole may be cased with a casing (or liner), such that the annular barrier may be provided between the casing and one of the upper and lower tubulars, and the pressure activated device may be exposed to pressure between the upper tubular and the casing, and the annular space may be between the annular barrier, upper tubular and the casing. Alternatively, a lower section of the borehole may not be cased and the annular barrier may be provided between the borehole and one of the upper and lower tubulars.

The annular space includes the different annuli, where present. As is conventional, multiple strings of casing (which are common but not essential) give rise to multiple annuli. The innermost annulus is labelled A- annulus and is normally between the innermost casing and a central tubular such as, inter alia, a test string; the next annulus is labelled the B-annulus between two casing strings immediately outside the A-annulus; the next annulus is labelled the C-annulus for the annulus between two casing strings outside the B-annulus, and so on. Thus the annular space as defined in the present invention, includes these various annuli, where present. Thus, the pressure activated device is exposed to pressure between the upper tubular and the borehole according to the invention and so can be utilised in any annulus such as the B- or outer annuli. However it is normally in the A-annulus within said annular space between the annular barrier, upper tubular and the borehole. Components of the well apparatus, such as the pressure activated device and transmitter, may be replicated and provided in the same or a different annulus.

The valve is normally spaced away from the annular barrier by up to 100 m, up to 50 m, optionally up to 20 m, though for multi-zone wells especially the valve may be much further away such as hundreds of metres away.

The lower tubular may extend from and below the annular barrier especially in a single zone completion.

However, especially in dual or multiple zone completions, the annular barrier may be an upper annular barrier and the well apparatus comprises a lower annular barrier, wherein the lower tubular extends from and below the lower annular barrier.

Circulating Valve

The well apparatus may also comprise a circulating valve located in the upper tubular and adapted to allow or resist flow of fluids between the longitudinal bore of the upper tubular and an annulus such as said annular space. The circulating valve may be coupled physically or wirelessly to the pressure activated device.

The pressure activated device is normally up to 500 m, optionally up to 100 m optionally up to 10 m, or may be up to 1 m from the circulating valve, and coupled thereto. The pressure activated device may be coupled to the circulating valve by at least one of wires or wireless transmission.

The pressure activated device may be integrated with the circulating valve.

In an interlock mode, the valve connected to the lower tubular and circulating valve are interlocked such that the two valves are not permitted to be in an allow-flow position at the same time. The interlock functionality may be achieved in a variety of ways. The position of the circulating valve and the valve connected to the lower tubular may be, in use, transmitted to a control station outside of the well, which provides said interlock to the valves; or to a control station within the well, optionally coupled (physically or wirelessly) to and within 20 m of the pressure activated device, or within 20 m of the valve connected to the lower tubular. The control station may be integral with the pressure activated device, circulating valve or valve connected to the lower tubular.

The well apparatus may comprise at least one further flowpath through at least one of the longitudinal bore of the lower tubular and a port in the lower tubular; and a further valve (or valves) connected to the lower tubular, the further valve(s) configured to allow or resist flow of fluids through said further flowpath(s). The further flowpath(s) may be an upstream or downstream portion of the flowpath described hereinabove. Alternatively it may be (a) separate flowpath(s).

The further valve may comprise a ball valve or a sleeve valve or other type of valve described herein.

Independent of the particular embodiment of the valve according to the present invention, the further valve may include any combination of the essential and optional features described herein of the valve according to the first aspect of the invention. The further valve can optionally be inserted with the lower tubular or run on wireline, coiled tubing or like methods at a later time.

Valves

A variety of valves may be used for the valve according to the first aspect of the present invention and, independently, for the further valve. For example ball valves and/or sleeve valves (sliding sleeve or rotating sleeve) are preferred. Piston valves and flapper valves may also be used. The valve may be deployed or recovered with the lower tubular. Alternatively, for certain embodiments it may be installed (retro-fitted) at a later date using wireline, coiled-tubing or like methods.

The valve may function as formation isolation valve, and/or function as a barrier, or equalization valve during string deployment, workover, and/or removal.

The valve can take up intermediate positions. The valve (or other means) may therefore provide choke functionality.

The valve may comprise a further device, such as a mechanical over-ride device, to open and/or close the valve. The further device may be controlled, for example, by pressure (through the tubing), wireline, or coiled tubing or other intervention methods. The valve may incorporate a 'pump through' facility to permit flow in one direction.

Annular Barrier

The annular barrier can take various forms. It can be the top of a cemented-in portion in the A-annulus or an annular sealing device.

The annular sealing device is a device which seals between two tubulars (or a tubular and the borehole), such as a packer element or a polished bore and seal assembly.

For particular embodiments therefore, the annular barrier is a narrower diameter (normally polished) bore in the casing with a seal assembly between the casing and the upper/lower tubulars.

The packer element may be part of a packer, bridge plug, or liner hanger, especially a packer or bridge plug. A packer includes a packer element along with a packer upper tubular and a packer lower tubular along with a body along on which the packer element is mounted.

The packer can be permanent or temporary. Temporary packers are normally retrievable and are run with a string and so removed with the string. Permanent packers on the other hand, are normally designed to be left in the well (though they could be removed at a later time).

A sealing portion of the annular sealing device may be elastomeric, non-elastomeric and/or metallic.

It can be difficult to control apparatus in the area below an annular sealing device between a casing/borehole and an inner production tubing or test string, especially independent of the fluid column in the inner production tubing. Thus embodiments of the present invention can provide a degree of control in this area.

This annular sealing device(s) may be wirelessly controlled. Thus where appropriate, it may be expandable and/or retractable by wireless signals.

Second Transmitter

The electronic transmitter may be a first transmitter. At least one, further electronic transmitter may be provided below the annular barrier configured to send information to above the annular barrier. Thus the communication device may comprise said further electronic transmitter. Optionally this is combined with the receiver in the form of a transceiver. It may be configured to transmit information on request and in any case may be associated with a memory device to store information. The information may be information regarding the status of the valve or other data from any sensors. The status of the valve may be its position, battery status, control system pressure and/or communication signal quality.

The further electronic transmitter is normally at least one of an electromagnetic, acoustic and inductively coupled tubular transmitter.

There may therefore be simultaneous communication between the further electronic transmitter, or a surface instrument, and at least one device below the annular barrier, such as a sensor, utilising wireless communication across the annular barrier, and the wireless communication of the default signal from the electronic transmitter. Said at least one device may include not only sensors and but controllable devices such as valves.

Preferably the wireless communication across the annular barrier, and the periodic default signal from the electronic transmitter independently utilize at least one of acoustic and electromagnetic communication mediums.

The wireless communication across the annular barrier, and the periodic default signal from the electronic transmitter may utilize the same or a different communication medium. If it is the same, the simultaneous communication may be achieved by using at least one of frequency-division multiplexing, time-division multiplexing, code-division multiplexing, and spread spectrum transmission.

Sensors

The well apparatus and/or the well may comprise at least one temperature sensor and optionally a (further) pressure sensor in addition to the pressure activated device. These may be above and/or especially below the annular barrier.

The pressure sensor may be below the annular barrier exposed to conditions below the annular barrier on a lower side of the flowpath and data from such sensor(s) may be part of the information the further electronic transmitter sends. The "lower side of the flowpath" is considered to be conditions below the annular barrier, although excluding the area through the lower tubular between the annular barrier and the valve.

The sensor(s) can be coupled (physically or wirelessly) to a wireless transmitter and data can be transmitted from the wireless transmitter to above the annular barrier (if provided below) towards the surface optionally via relays. Data can be transmitted in at least one of the following forms: electromagnetic, acoustic, and inductively coupled tubulars, especially acoustic and/or electromagnetic as described herein.

Such short range wireless coupling may be facilitated by EM communication in the VLF range.

A variety of other sensors may be provided, including acceleration, vibration, torque, movement, motion, radiation, noise, magnetism, corrosion; chemical or radioactive tracer detection; fluid identification such as hydrate, wax and sand production; and fluid properties such as (but not limited to) flow, density, water cut, for example by capacitance and conductivity, pH and viscosity. Furthermore the sensors may be adapted to induce the signal or parameter detected by the incorporation of suitable transmitters and mechanisms. The sensors may also sense the status of other parts of the apparatus or other equipment within the well, for example valve member position or motor rotation of the pump.

An array of discrete temperature sensors or a distributed temperature sensor can be provided (for example run in) with the apparatus. Optionally therefore it may be below the annular barrier. These temperature sensors may be contained in a small diameter (e.g. ¼") tubing line and may be connected to a transmitter or transceiver. If required any number of lines containing further arrays of temperature sensors can be provided. This array of temperature sensors and the combined system may be configured to be spaced out so the array of temperature sensors contained within the tubing line may be aligned across the formation, for example the communication paths; either for example generally parallel to the well, or in a helix shape.

The array of discrete temperature sensors may be part of the apparatus or separate from it.

The temperature sensors may be electronic sensors or may be a fibre optic cable.

Therefore in this situation the additional temperature sensor array could provide data from the communication path interval(s) and indicate if, for example, communication paths are blocked/restricted. The array of temperature sensors in the tubing line can also provide a clear indication of fluid flow, particularly when the apparatus is activated. Thus for example, more information can be gained on the response of the communication paths—an upper area of communication paths may have been opened and another area remain blocked and this can be deduced by the local temperature along the array of the sensors.

Such temperature sensors may also be used before, during and after pumping the fluid and therefore used to check the effectiveness of the apparatus.

Data may be recovered from the sensors, before, during and/or after the valve is operated in response to the control signal. Recovering data means getting it to the surface.

Data may be recovered from the sensors, before, during and/or after a perforating gun has been activated in the well.

The data recovered may be real-time/current data and/or historical data.

Data may be recovered by a variety of methods. For example it may be transmitted wirelessly in real time or at a later time, optionally in response to an instruction to transmit.

Or the data may retrieved by a probe run into the well on wireline/coiled tubing or a tractor; the probe can optionally couple with the memory device physically or wirelessly.

Memory

The apparatus especially the sensors, may comprise a memory device which can store data for recovery at a later time. The memory device may also, in certain circumstances, be retrieved and data recovered after retrieval.

The memory device may be configured to store information for at least one minute, optionally at least one hour, more optionally at least one week, preferably at least one month, more preferably at least one year or more than five years.

Where separate, the memory device and sensors may be connected together by any suitable means, optionally wirelessly or physically coupled together by a wire. Inductive coupling is also an option. Short range wireless coupling may be facilitated by EM communication in the VLF range.

Signals

The first transmitter sends acoustic or EM signals and any further transmitters may be a wireless transmitter configured to send signals, at least in part, preferably in at least one of the following wireless forms: acoustic, electromagnetic and inductively coupled tubulars. References herein to "wireless", relate to said forms, unless where stated otherwise. Acoustic and electromagnetic are especially preferred.

Signals—General

The signals may be data or control signals which need not be in the same wireless form. Accordingly, the options set out herein for different types of wireless signals are independently applicable to data and control signals. The control signals can control downhole devices including sensors. Data from sensors may be transmitted in response to a control signal. Moreover data acquisition and/or transmission parameters, such as acquisition and/or transmission rate or resolution, may be varied using suitable control signals.

Preferably the signals are such that they are capable of passing through the annular barrier when fixed in place, although for certain embodiments, they may travel indirectly, for example around any annular sealing device.

EM/Acoustic signals use the well, borehole or formation as the medium of transmission. The EM/acoustic or pressure signal may be sent from the well, or from the surface. If provided in the well, an EM/acoustic signal can travel through any annular sealing device, although for certain embodiments, it may travel indirectly, for example around any annular sealing device.

Electromagnetic and acoustic signals are especially preferred-they can transmit through/past an annular barrier without inductively coupled tubular infrastructure, and for data transmission, the amount of information that can be transmitted is normally higher compared to coded pressure pulsing, especially receiving data from the well.

Therefore, the communication device may comprise an acoustic communication device and the control signal comprises an acoustic control signal and/or the communication device may comprise an electromagnetic communication device and the control signal comprises an electromagnetic control signal.

Similarly the transmitters and receivers used correspond with the type of signals used. For example an acoustic transmitter and receiver are used if acoustic signals are used.

Where inductively coupled tubulars are used, especially for data recovery, there is normally at least ten, usually many more, individual lengths of inductively coupled tubular which are joined together in use, to form a string of inductively coupled tubulars. They have an integral wire and may be formed from tubulars such as tubing, drill pipe or casing. At each connection between adjacent lengths there is an inductive coupling. The inductively coupled tubulars that may be used can be provided by, for example, N O V under the brand Intellipipe®.

Thus, the control signal is often conveyed a relatively short distance from above to below the annular barrier, such as less than 100 m or less than 50 m. However the communication device with the receiver may be spaced away from the annular barrier, and therefore the control signal can be sent for a longer distance such as at least 100 m, optionally more than 200 m or longer. The distance travelled may be much longer, depending on the length of the well.

Data and commands within the signal may be relayed or transmitted by other means. Thus a data signal could be, for example, converted to other types of wireless or wired signals, and optionally relayed, by the same or by other means, such as hydraulic, electrical and fibre optic lines. In one embodiment, signals may be transmitted through a cable for a first distance, such as over 400 m, and then transmitted via acoustic or EM communications for a smaller distance, such as 200 m. In another embodiment data signals are transmitted for 500 m using inductively coupled tubulars and then 1000 m using a hydraulic line.

Thus whilst non-wireless means may be used to transmit the signal, preferred configurations preferentially use wireless communication. Thus, whilst the distance travelled by the signal for data recovery is dependent on the depth of the well, often the wireless signal for data recovery, including relays but not including any non-wireless transmission, travel for more than 1000 m or more than 2000 m. Preferred embodiments also have data signals transferred by wireless signals (including relays but not including non-wireless means) at least half the distance from the surface of the well to the apparatus.

Different wireless signals may be used in the same well for communications going from the well towards the surface, and for communications going from the surface into the well.

Acoustic

Acoustic signals and communication may include transmission through vibration of the structure of the well including tubulars, casing, liner, drill pipe, drill collars, tubing, coil tubing, sucker rod, downhole tools; transmission via fluid (including through gas), including transmission through fluids in uncased sections of the well, within tubulars, and within annular spaces; transmission through static or flowing fluids; mechanical transmission through wireline, slickline or coiled rod; transmission through the earth; transmission through wellhead equipment. Communication through the structure and/or through the fluid are preferred.

Acoustic transmission may be at sub-sonic (<20 Hz), sonic (20 Hz-20 kHz), and ultrasonic frequencies (20 kHz-2 MHz). Preferably the acoustic transmission is sonic (20 Hz-20 khz).

The acoustic signals and communications may include Frequency Shift Keying (FSK) and/or Phase Shift Keying (PSK) modulation methods, and/or more advanced derivatives of these methods, such as Quadrature Phase Shift Keying (QPSK) or Quadrature Amplitude Modulation (QAM), and preferably incorporating Spread Spectrum Techniques. Typically they are adapted to automatically tune acoustic signalling frequencies and methods to suit well conditions.

The acoustic signals and communications may be uni-directional or bi-directional. Piezoelectric, moving coil transducer or magnetostrictive transducers may be used to send and/or receive the signal.

EM

Electromagnetic (EM) (sometimes referred to as Quasi-Static (QS)) wireless communication is normally in the frequency bands of: (selected based on propagation characteristics)

- sub-ELF (extremely low frequency) <3 Hz (normally above 0.01 Hz);
- ELF 3 Hz to 30 Hz;
- SLF(super low frequency) 30 Hz to 300 Hz;
- ULF (ultra low frequency) 300 Hz to 3 kHz; and,
- VLF (very low frequency) 3 kHz to 30 kHz.

An exception to the above frequencies is EM communication using the pipe as a wave guide, particularly, but not exclusively when the pipe is gas filled, in which case frequencies from 30 kHz to 30 GHz may typically be used dependent on the pipe size, the fluid in the pipe, and the range of communication. The fluid in the pipe is preferably non-conductive.

U.S. Pat. No. 5,831,549 describes a telemetry system involving gigahertz transmission in a gas filled tubular waveguide.

Sub-ELF and/or ELF are preferred for communications from a well to the surface (e.g. over a distance of above 100 m). For more local communications, for example less than 10 m, VLF is preferred. The nomenclature used for these ranges is defined by the International Telecommunication Union (ITU).

EM communications may include transmitting communication by one or more of the following: imposing a modulated current on an elongate member and using the earth as return; transmitting current in one tubular and providing a return path in a second tubular; use of a second well as part of a current path; near-field or far-field transmission; creating a current loop within a portion of the well metalwork in order to create a potential difference between the metalwork and earth; use of spaced contacts to create an electric dipole transmitter; use of a toroidal transformer to impose current in the well metalwork; use of an insulating sub; a coil antenna to create a modulated time varying magnetic field for local or through formation transmission; transmission within the well casing; use of the elongate member and earth as a coaxial transmission line; use of a tubular as a wave guide; transmission outwith the well casing.

Especially useful is imposing a modulated current on an elongate member and using the earth as return; creating a current loop within a portion of the well metalwork in order to create a potential difference between the metalwork and earth; use of spaced contacts to create an electric dipole transmitter; and use of a toroidal transformer to impose current in the well metalwork.

To control and direct current advantageously, a number of different techniques may be used. For example one or more of: use of an insulating coating or spacers on well tubulars; selection of well control fluids or cements within or outwith tubulars to electrically conduct with or insulate tubulars; use of a toroid of high magnetic permeability to create inductance and hence an impedance; use of an insulated wire, cable or insulated elongate conductor for part of the transmission path or antenna; use of a tubular as a circular waveguide, using SHF (3 GHz to 30 GHz) and UHF (300 MHz to 3 GHz) frequency bands.

Suitable means for receiving the transmitted signal are also provided, these may include detection of a current flow; detection of a potential difference; use of a dipole antenna; use of a coil antenna; use of a toroidal transformer; use of a Hall effect or similar magnetic field detector; use of sections of the well metalwork as part of a dipole antenna.

Where the phrase "elongate member" is used, for the purposes of EM transmission, this could also mean any elongate electrical conductor including: liner; casing; tubing or tubular; coil tubing; sucker rod; wireline; drill pipe; slickline or coiled rod.

A means to communicate signals within a well with electrically conductive casing is disclosed in U.S. Pat. No. 5,394,141 by Soulier and U.S. Pat. No. 5,576,703 by MacLeod et al both of which are incorporated herein by reference in their entirety. A transmitter comprising oscillator and power amplifier is connected to spaced contacts at a first location inside the finite resistivity casing to form an electric dipole due to the potential difference created by the current flowing between the contacts as a primary load for the power amplifier. This potential difference creates an electric field external to the dipole which can be detected by either a second pair of spaced contacts and amplifier at a second location due to resulting current flow in the casing or alternatively at the surface between a wellhead and an earth reference electrode.

Relay

A relay comprises a transceiver (or receiver) which can receive a signal, and an amplifier which amplifies the signal for the transceiver (or a transmitter) to transmit it onwards.

There may be at least one relay. The at least one relay (and the transceivers or transmitters associated with the apparatus or at the surface) may be operable to transmit a signal for at least 200 m through the well. One or more relays may be configured to transmit for over 300 m, or over 400 m.

When using acoustic communication (especially for retrieving data) there may be more than five, or more than ten relays, depending on the depth of the well and the position of the apparatus.

Generally, less relays are required when using EM communications. For example, especially for retrieving data, there may be only a single relay. Optionally therefore, an EM relay (and the transceivers or transmitters associated with the apparatus or at the surface) may be configured to transmit for over 500 m, or over 1000 m.

The transmission may be more inhibited in some areas of the well, for example when transmitting across the annular barrier. In this case, the relayed signal may travel a shorter distance. However, where a plurality of acoustic relays are provided for retrieving data, preferably at least three are operable to transmit a signal for at least 200 m through the well.

When using inductively coupled tubulars, a relay may also be provided, for example every 300-500 m in the well, especially when retrieving data.

The relays may keep at least a proportion of the data for later retrieval in a suitable memory means.

Taking these factors into account, and also the nature of the well, the relays can therefore be spaced apart accordingly in the well.

Wireless communication is not necessarily symmetric in the upward and downward direction in the well, for instance, due to the presence of localized noise sources. Thus different modes of communication may be used in different directions, for example pressure pulsing within the annulus may be used to send control signals from surface, whilst data is sent to surface using acoustic or electromagnetic communication.

The control signals may cause, in effect, immediate activation, or may be configured to activate the apparatus after a time delay, and/or if other conditions are present such as a particular pressure change.

Electronics

The apparatus may comprise at least one battery (optionally a rechargeable battery) normally above and below the annular barrier. These may provide power to the receiver (optionally a transceiver) below the annular barrier or the first and further transmitters (optionally first and further transceivers) above and below the annular barrier; and/or to other components. The battery/batteries may be at least one of a high temperature battery, a lithium battery, a lithium oxyhalide battery, a lithium thionyl chloride battery, a lithium sulphuryl chloride battery, a lithium carbon-monofluoride battery, a lithium manganese dioxide battery, a lithium ion battery, a lithium alloy battery, a sodium battery, and a sodium alloy battery. High temperature batteries are those operable above 85° C. and sometimes above 100° C. The battery system may include a first battery and further reserve batteries which are enabled after an extended time in the well. Reserve batteries may comprise a battery where the electrolyte is retained in a reservoir and is combined with the anode and/or cathode when a voltage or usage threshold on the active battery is reached.

The communication device is normally an electronic communication device.

The battery and optionally elements of the control electronics may be replaceable without removing tubulars. They may be replaced by, for example, using wireline or coiled tubing. The battery may be situated in a side pocket.

The apparatus, especially the control mechanism, preferably comprises a microprocessor. A further microprocessor may be provided above the annular barrier. Electronics in the apparatus, to power various components such as the microprocessor(s), control and communication systems, and optionally the valve, are preferably low power electronics. Low power electronics can incorporate features such as low voltage microcontrollers, and the use of 'sleep' modes where the majority of the electronic systems are powered off and a low frequency oscillator, such as a 10-100 kHz, for example 32 kHz, oscillator used to maintain system timing and 'wake-up' functions. Synchronised short range wireless (for example EM in the VLF range) communication techniques can be used between different components of the system to minimize the time that individual components need to be kept 'awake', and hence maximise 'sleep' time and power saving.

The low power electronics facilitates long term use of various components of the apparatus. The control mechanism may be configured to be controllable by the control signal up to more than 24 hours after being run into the well, optionally more than 7 days, more than 1 month, or more than 1 year or up to 5 years. It can be configured to remain dormant before and/or after being activated.

Deployment

For certain embodiments, the upper and lower tubulars may be deployed with the annular barrier or after an annular barrier is provided in the well following an earlier operation. In the former case, it may then be provided on the same string as the annular barrier and deployed into the well therewith. Thus the upper and lower tubular (and optionally the annular barrier) may be a continuous assembly. In the latter case, it may be retro-fitted into the well and moved past the annular barrier. In this latter example, the lower tubular may be stabbed into and through a packer previously set; or the valve may be connected to a plug or hanger, and the plug or hanger in turn connected directly or indirectly, for example by tubulars, to the annular barrier. The plug may be a bridge plug, wireline lock, tubular/drill pipe set barrier, shut-in tool or retainer such as a cement retainer. The plug may be a temporary or permanent plug.

In certain embodiments, the upper and lower tubulars may be run as part of a tubular string, such as a test, completion, observation, suspension, abandonment, drill, tubing, casing or liner string.

The annular barrier may be run into the well as a permanent barrier designed to be left in the well, or run into the well as a retrievable barrier which is designed to be removed from the well.

For certain embodiments, the apparatus may be deployed in a central bore of a pre-existing tubular in the well, rather than into a pre-existing annulus in the well. An annulus may be defined between the apparatus and a pre-existing tubular in the well.

Further Procedure

The well apparatus may be used to control a valve below the annular barrier optionally in preparation for a test or further procedure.

According to a further aspect of the present invention there is provided a method to conduct a procedure or test on a well, comprising:

providing a well apparatus in a well as described herein;

conducting a procedure/test on the well, the procedure/test includes one or more of a build-up test, drawdown test, connectivity tests such as an interference or pulse test, a drill stem test (DST), extended well test (EWT), hydraulic fracturing, mini frac, pressure test, flow test, injection test, well/reservoir treatment such as an acid treatment, permeability test, injection procedure, gravel pack operation, perforation operation, string deployment, workover, suspension and abandonment.

The test is normally conducted on the well before removing the apparatus from the well, if it is removed from the well, and can be performed during all well phases, such as drilling, production/completion, observation, suspension and abandonment.

The well may be openhole and/or pre-perforated.

The procedure may be a drill stem test (DST). Thus a DST string and the annular barrier may be deployed as part of the DST. After the DST has been conducted, the valve controls flow into the DST test string and is closed and the well suspended. The portion of the DST string above the annular barrier can then, optionally, be removed. The well below the annular barrier can then be monitored using at least one sensor and transmitter below the annular barrier.

The sensors may provide information on connectivity tests such as a pulse test or an interference test.

A pulse test is where a pressure pulse is induced in a formation at one well/isolated section of the well and detected in another "observing" well or separate isolated section of the same well, and whether and to what extent a pressure wave is detected in the observing well or isolated section provides useful data regarding the pressure connectivity of the reservoir between the wells/isolated sections. Such information can be useful for a number of reasons, such as to determine the optimum strategy for extracting fluids from the reservoir.

An interference test is similar to a pulse test, but monitors longer term effects at an observation well or isolated section following production (or injection) in a separate well or isolated section.

Moreover, the well could be reopened at a later date for example by adding a production string. The valve below the packer, which previously functioned as a tester valve, can thereafter function as a formation isolation valve or inflow control valve. It can then be switched from a default close mode to a default open mode.

If the well is abandoned by cementing above the annular sealing barrier (and normally adding a further barrier) the wireless signals may still be used to monitor the well below the annular barrier for at least a day, a week, a month, or a year, or more than 5 years.

Miscellaneous

The well may be a subsea well. Wireless communications can be particularly useful in subsea wells because running cables in subsea wells is more difficult compared to land wells. The well may be a deviated or horizontal well, and embodiments of the present invention can be particularly suitable for such wells since they can avoid running wireline, cables or coiled tubing which may be difficult or not possible for such wells.

References herein to perforating guns includes perforating punches, both of which are used to create a flowpath between the formation and the well.

Transceivers, which have transmitting functionality and receiving functionality; may be used in place of the transmitters and receivers described herein.

All pressures herein are absolute pressures unless stated otherwise.

The well is often an at least partially vertical well. Nevertheless, it can be a deviated or horizontal well. References such as "above" and below" when applied to deviated or horizontal wells should be construed as their equivalent in wells with some vertical orientation. For example, "above" is closer to the surface of the well through the well.

A zone is defined herein as formation adjacent to or below the lowermost barrier, or a portion of the formation adjacent to the well which is isolated in part between barriers and which has, or will have, at least one communication path (for example perforation) between the well and the surrounding formation, between the barriers. Thus each additional barrier set in the well defines a separate zone except areas between two barriers (for example a double barrier) where there is no communication path to the surrounding formation and none are intended to be formed. The barriers may be annular barriers.

References herein to cement include cement substitute. A solidifying cement substitute may include epoxies and resins, or a non-solidifying cement substitute may be Sandaband™

Embodiments of the present invention will now be described, by way of example only, with reference to the accompanying figures, in which:

FIG. 1 is a diagrammatic sectional view of a first DST embodiment of a well and well apparatus in accordance with one aspect of the present invention;

FIG. 2*a* shows a graph plotting pressure against time in an annulus around the time when pressure is applied at the surface and typical pressure changes are encountered;

FIG. 2*b* shows a graph plotting pressure against time in an annulus around the time when pressure is applied at the surface, and includes one example of a characteristic change in pressure;

FIG. 2*c* shows a graph plotting pressure against time in an annulus showing a further example of a characteristic change in pressure;

FIG. 2*d* shows a graph plotting pressure against time in an annulus showing a yet further example of a characteristic change in pressure;

FIG. 3 is a diagrammatic sectional view of a second embodiment of a well and well apparatus comprising a packer with a dynamic seal, in accordance with one aspect of the present invention;

FIG. 4*a* is a diagrammatic sectional view of an embodiment of a well apparatus comprising two packers, in accordance with one aspect of the present invention;

FIG. 4*b* is a diagrammatic sectional view of an embodiment of a multi-zone well and well apparatus comprising two packers, in accordance with one aspect of the present invention;

Figure 1:
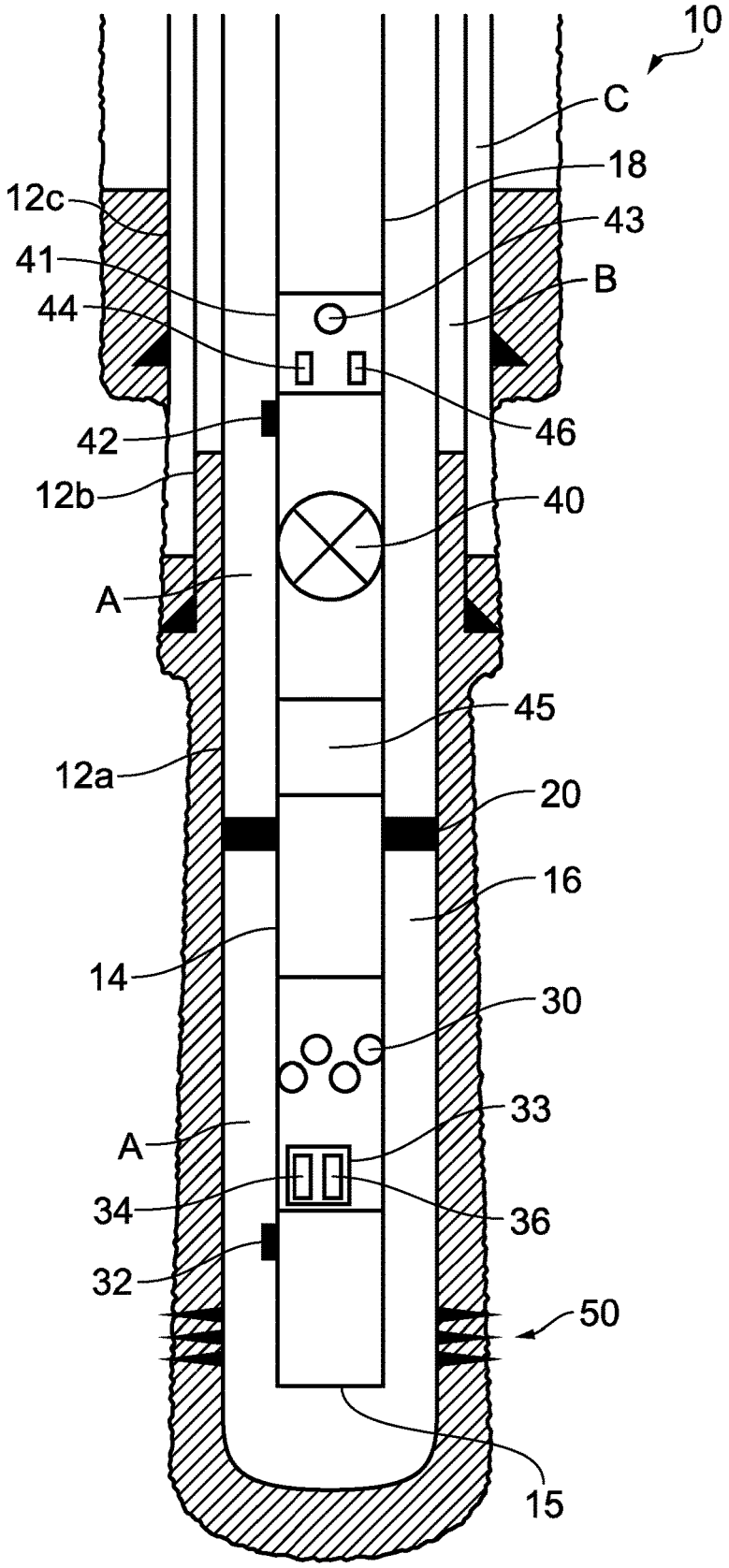

FIG. 1 shows a well 16 with a well apparatus 10 comprising a series of casing strings 12*a*, 12*b* & 12*c*; tubulars 14,18 provided inside the innermost casing 12*a*, an annular barrier comprising a retrievable/temporary packer element 20, a shut-off valve 30, a tester valve 40 and a circulating valve 41. Inside each of the casing strings 12*a*, 12*b* & 12*c* there is an annulus A, B & C respectively.

The shut-off valve 30 is provided below the packer element 20 and controlled by signals from a transmitter 44 in the A-annulus above the packer element 20. (Alternative embodiments could use the B-annulus). The transmitter 44 is coupled to a pressure sensor 42 provided in the same annulus. An electronic control mechanism 33 comprises a wireless transceiver (or receiver) 34 and a programmable control system 36. The wireless receiver 34 is coupled to the shut-off valve 30.

The components of the control mechanism 33 (the transceiver 34 and the programmable control system 36 which controls the valve 30) are normally provided adjacent each other, or close together as shown; but may be spaced apart.

As will be described in more detail below, in use, the shut-off valve 30 is normally configured to remain open so long as there are elevated pressures in the A-annulus. In the event of a characteristic change in pressure (for example a depressurisation) of the A-annulus, indicative communications from the transmitter 44 to the receiver 34 causes it to close. Flow of fluids from the well via a flowpath in the shut-off valve 30 is thereby resisted.

The characteristic change in pressure may be the result of activating a control device (for example a valve) at the surface of the well to quickly bleed the pressure from the A-annulus. This provides a very quick way to effectively instruct the shut-off valve 30 to close. A loss of well integrity can also cause the pressure in the A-annulus to drop and the shut-off valve 30 to close in response.

Thus an advantage of such embodiments is that in the event of an emergency, caused by loss of well integrity, flow from the well can be shut down from a lower point in the well than is conventional. Accordingly more of the well above this point may be isolated, therefore increasing the likelihood of isolating the position in the well where integrity is lost, and therefore improving safety by controlling the reservoir. This can be very useful in, for example, DST operations or a production completion.

This embodiment of the invention will now be described in more detail.

The casing strings 12*a*, 12*b* respectively extend further into the well 16 than the adjacent casing strings 12*b*, 12*c* on the outside thereof. The lowermost casing string 12*a* contains perforations 50 in the lower part of the well 16 which allows well fluids to flow into the well 16.

The tubulars 14, 18 are part of a DST string and extend into a tubular within the packer element 20 which thus defines an upper 18 and lower 14 tubular in fluid communication with each other. In this embodiment, the lower tubular 14, upper tubular 18 and packer element 20 are a continuous assembly.

A gauge carrier 45 may be provided on the upper tubular 18.

The shut-off valve 30 is a sleeve valve and is located less than 10m below the packer element 20. In an alternative embodiment other valves such as ball valves may be used. The valves may be multicycle valves. An end 15 of the lower tubular 14 is blocked to prevent fluid flow at this point between the lower tubular 14 and surrounding portion of the well 16.

Below the packer element 20 there is provided the wireless receiver 34. The receiver 34 is coupled (wirelessly or physically) to the shut-off valve 30, allowing it to be electronically controlled by wireless signals via the receiver 34.

The well apparatus 10 comprises a pressure sensor 42 located in the A-annulus above the packer element 20 to monitor the pressure therein. The pressure sensor 42 is coupled to the wireless transmitter 44. The transmitter 44 transmits a signal from above the packer element 20 to the receiver 34 located below the packer element 20.

In use in a default (failsafe)-close mode, the transmitter 44 sends an intermittent signal to the receiver 34 which in turn instructs the shut-off valve 30 to stay open. Whilst the interval between intermittent signals can be varied from one embodiment to another (or indeed at different intervals for a single embodiment), in one example, the transmitter 44 sends a signal to the receiver 34 once every ten seconds to instruct the shut-off valve 30 to stay open. If this signal is not received by the receiver 34 after a specified period of time, such as thirty seconds, the programmable control system 36 associated with the shut-off valve 30 will instruct the shut-off valve 30 to close. Thus this embodiment provides a default close mode, should the transmitter 44 lose communication with the receiver 34.

If the pressure in the annulus drops below a specified value or amount, such as by 1000 psi, the transmitter 44 will no longer send an "open" signal to the receiver 34 but attempt to send a "close" signal. On receiving such a close signal, the programmable control system 36 associated with the shut-off valve 30 will instruct the shut-off valve 30 to close. The drop in pressure may be caused by damage to the well or due to loss of pressure in the A-annulus caused by an operator at the surface activating a control system (not shown) to bleed the pressure in the A-annulus. Moreover this functionality can be used, by an operator, to shut-in the well at the end of a normal procedure by controlled bleeding of the pressure in the A-annulus.

In a DST application, rather than using a conventional tester valve above the packer element 20, the shut-off valve 30 may be used to control flow from the well 16 and perform the DST testing operations. In such an embodiment, a master control signal overrides the communications between the transmitter 44 and receiver 34, and controls the shut-off valve 30 to control the operational mode of the valve during normal DST testing operations. An advantage of such embodiments is that the shut-off valve is lower in the well than a conventional tester valve. As such, the effect of fluids in the well is minimised (known as the borehole storage effect) and the data from the DST test more closely reflects the reservoir characteristics. This can also be useful, for example, when conducting a build-up or fall-off test on a production or injection well.

Optionally, a sensing module 32 is provided to detect various parameters on the reservoir (generally lower) side of the flowpath. For example, it may include pressure, temperature and valve position sensors. The sensing module 32 is coupled to the receiver 34 which in this embodiment has transceiver functionality in order to transmit data to a location above the packer element 20, including to the surface e.g. wirelessly, for example by acoustic or electromagnetic signals.

In a DST application, the tester valve 40 is not essential although it may be configured to allow or resist the flow of fluids through the flowpath of the upper tubular 18 in response to a characteristic change in the pressure in the A-annulus.

An advantage of providing a secondary valve 40 in a well 10, means that if one valve 30, 40 fails, the whole DST string does not need to be removed (which can be a very time consuming operation) to provide such testing functionality.

Moreover in a particularly preferred embodiment, where two valves are used, their types are different. For example, one above the packer element may be a ball valve and one below may be a sleeve valve.

A circulating valve 41 is provided above the packer element 20. The circulating valve 41 comprises the transmitter 44 and also a circulating port 43 between the longitudinal bore of the upper tubular 18 and the well 16. The circulating valve 41 further comprises a control system 46 which provides an electronic interlock to prevent the circulating valve 41 and the shut-off valve 30 being open at the same time. In alternative embodiments, the control system itself locks to prevent the valves being open at the same time. The valves 30, 40 may be single or multicycle valves, i.e. for multicycle valves they can open or close several times, to resist or allow flow through their respective flowpaths.

A yet further advantage of certain embodiments is that remedial action in the event of valve failure may be easier. For example, if a conventional valve fails in a closed position and therefore prevents flow through associated tubulars, generally the string will need to be pulled out and replaced, which is a time consuming and therefore expensive process.

Oftentimes, the well will need to be killed before the string is removed, and this may also require milling of the valve which is difficult and time consuming.

In contrast, for certain embodiments of the invention, in the event of the valve below the packer element failing, the tubular below the packer element may be perforated, to provide access to the well.

For certain embodiments, a further valve may be provided below the packer element, and this can also be used for such an eventuality. The valve may be a single shot valve or multicycle valve.

In such scenarios, the well can be brought under control much more readily and indeed, it may be possible to continue to conduct the test or other operations with other valves, such as a valve below or above the packer or a surface shut in valve. Thus time can be saved compared to similar scenarios in conventional wells.

In alternative embodiments, one or both of the transmitter in the A-annulus and receiver below the packer element, may be transceivers.

In the present embodiment, the tester valve 40 and the circulating valve 41 are provided separately. In alternative embodiments, the tester valve 40 comprises the circulating valve 41.

For certain embodiments, additional apparatus (or components of the apparatus) can be added to the tubulars 14 and/or 18 to provide redundancy if required.

Whilst illustrated separately, the receiver and programmable control system are often provided in the same device.

Figure 2A:
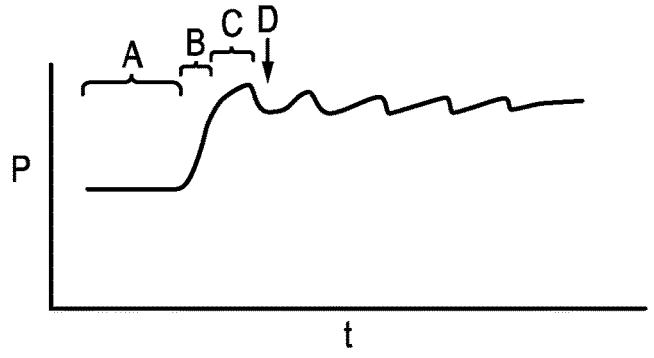

FIG. 2*a* shows a graph plotting pressure against time in an annulus around the time when pressure is applied at the surface and typical pressure changes are encountered during a well test. The pressure at the start (A) is a result of the hydrostatic pressure of fluid in the annulus (usually A-Annulus). A master control signal is sent to the control system 46 associated with the transmitter 44 to put the well apparatus 10 into a well test mode (a failsafe/default close mode), which is configured to shut the valve 30 if there is insufficient pressure in the annulus. At (A) therefore, the valve 30 remains closed because there is insufficient pressure in the annulus. The annulus is then pressured up by around 1000 psi (B) and the pressure in the annulus closed in. The increased pressure in the annulus is detected by the pressure sensor 42, and the programmable control system 36 recognises that this is of a sufficient pressure magnitude to open the valve 30. Accordingly, it sends a signal via the transmitter 44 to the receiver 34 below the packer element 20 instructing the valve 30 to open.

The flow of fluids through the well raises the temperature in the annulus and therefore pressure in the annulus further (C), by around 100-200 psi. However, the well is still operating appropriately and this further change (C) does not indicate a characteristic change in pressure; rather, this is the pressure expected during such an operation.

In order to prevent the annulus pressure rising excessively, the operator will normally controllably bleed some pressure from the annulus, resulting in a drop in pressure (D). There follows a series of pressure rises, caused by heating of the annulus by the produced fluids; and pressure drops, caused by controlled bleeding of the annulus to prevent excessive pressure.

The characteristic change in pressure is a change in pressure which can be distinguished from the normal pressure changes expected, such as those shown in FIG. 2*a* after the valve 30 has opened (B).

Figure 2B:
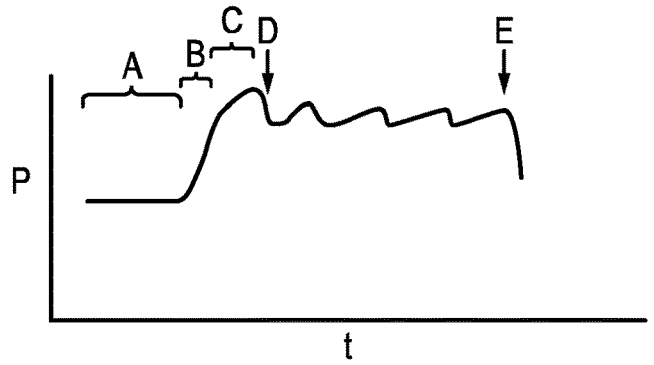

In FIG. 2*b* the same pressure changes (A) to (D) occur, and additionally at (E) a larger and characteristic drop in pressure occurs, clearly distinguishable from the relatively small pressure fluctuations after point C. At (E) the pressure sensor 42 will detect the drop in pressure and the control system 46 will recognise there is insufficient pressure in the A-annulus. In such a circumstance, it can be programmed to stop sending the 'open' signal to the receiver 34 below the packer element 20 via the transmitter 44. The programmable control system 36 below the packer can be programmed to close the valve 30 in the continued absence of such a signal.

Additionally or alternatively, the control system 46 may send a positive "close" signal to the programmable control system 36 of the valve 30 via the transmitter 44 and receiver 34.

Figure 2C:
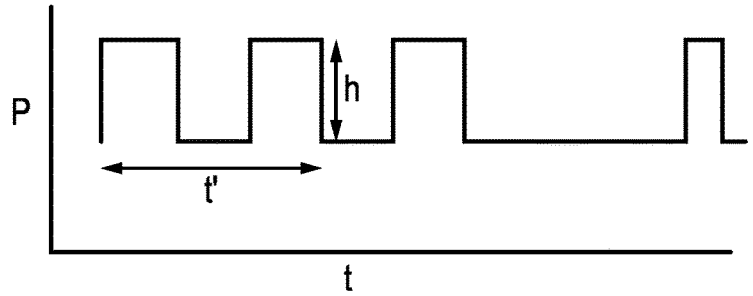

FIG. 2*c* shows one example using pressure key sequencing. Pressure increases and decreases are imposed on the pressure in the annulus and such a sequence is a characteristic change in pressure and can be clearly distinguished from the changes shown in FIG. 2*a* after point C. The height of the peaks, their duration and frequency can be varied in order to encode data.

The data can also be encoded for example by using the time (t') between consecutive peaks, and the height (h) of the peaks. This characteristic change in pressure can thus control a valve such as the shut-off valve 30, below an annular barrier, such as the packer element 20.

Figure 2D:
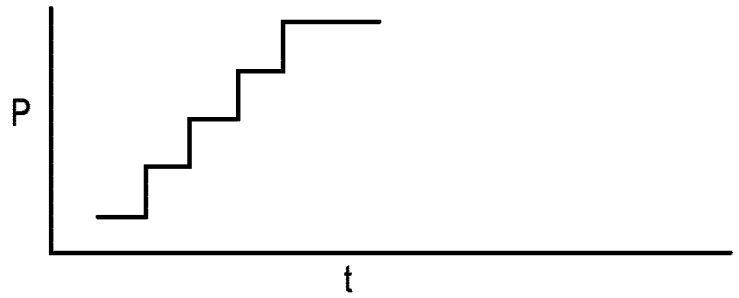

Another example is shown in FIG. 2*d* where pressure is ramped up in a stepwise fashion and this sequence is a characteristic change in pressure. Information can similarly be encoded in this way. Many other options are possible, such as those disclosed in U.S. Pat. No. 5,273,112 the disclosure of which is incorporated herein by reference in its entirety and especially with respect to FIGS. 5-10 thereof and associated description.

Figure 3:
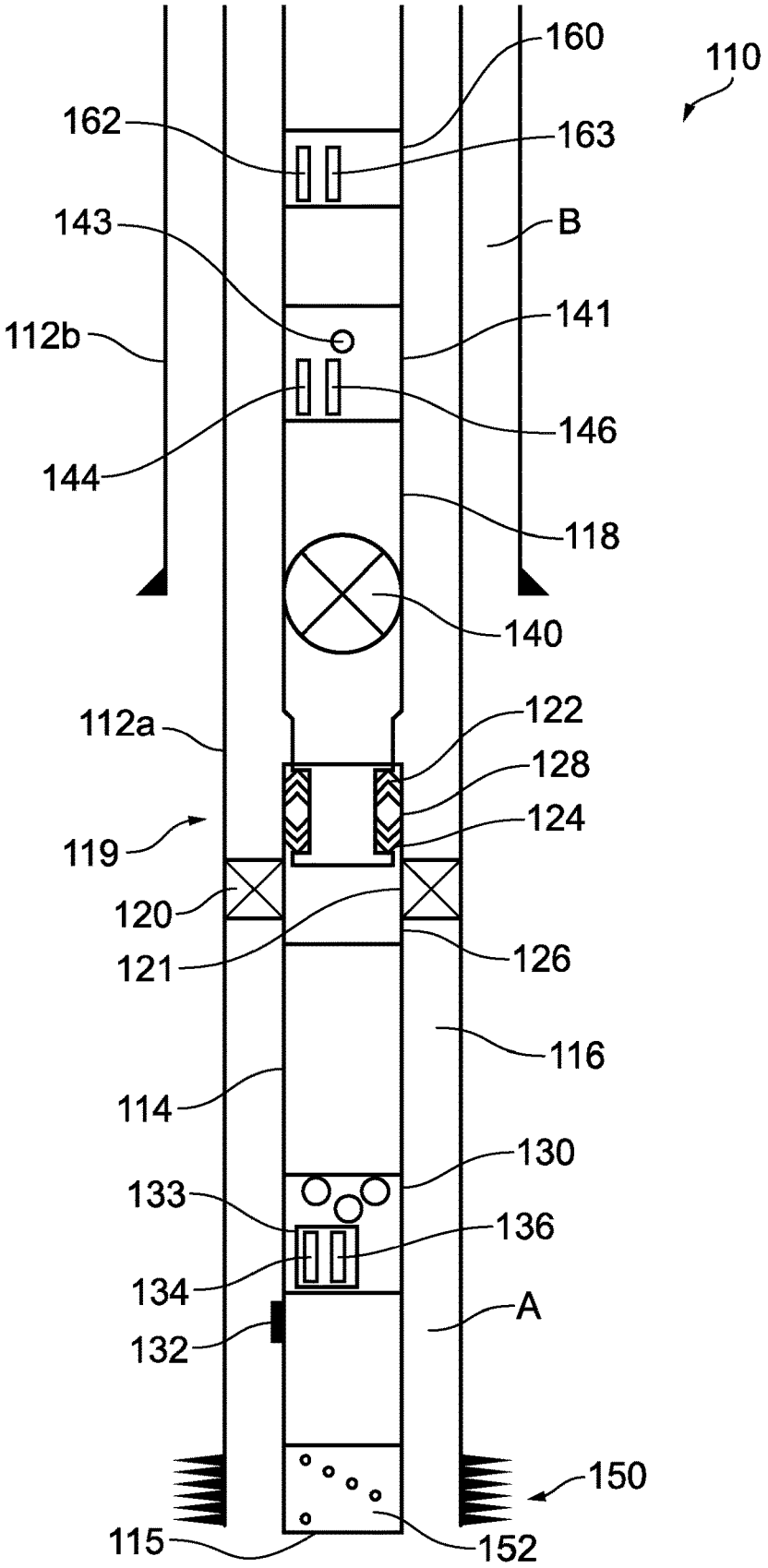

FIG. 3 shows an alternative embodiment of the present invention. Where the features are the same as the first embodiment, they have been labelled with the same number except preceded by a '1'. These features will not be described in detail again here.

This embodiment comprises a packer 119 comprising a packer element 120, a packer upper tubular 128 and a packer lower tubular 126. A dynamic seal 122 is located within a polished bore receptacle 124 of the packer upper tubular 128 above the packer element 120.

An inside diameter of the packer element 120 defines an inner bore 121 of the packer 119.

A circulating valve 141 is located in the upper tubular 118. The circulating valve 141 comprises a circulating port 143 between the longitudinal bore of the upper tubular 118 and the well 116. Coupled to the circulating valve 141 is a wireless transceiver such as an electromagnetic or acoustic transceiver 144 and a control system 146. The control system 146 provides an electronic interlock to prevent the circulating valve 141 and the shut-off valve 130 being open at the same time. The valves may be single or multicycle valves. An electronic control mechanism 133 comprises a wireless receiver 134 and a programmable control system 136. The wireless receiver 134 is coupled to the shut-off valve 130.

The well apparatus 110 further comprises an instrument carrier 160 above the circulating valve 141 in the upper tubular 118. The instrument carrier 160 comprises a wireless transceiver such as an electromagnetic or acoustic transceiver 162. The instrument carrier 160 also comprises a pressure sensor 163 coupled to the transceiver 162. In use, the flow of warm fluids through the DST string causes thermal expansion thereof and using a static seal between a DST string and a packer, can result in compression therebetween. Furthermore, the flow of cold fluids (for example produced gas or fluids introduced from surface) through the DST string can cause contraction of the DST string, and using a static seal between a DST string and a packer could result in excessive tension therebetween. Using a dynamic seal instead of a static seal allows for a degree of movement between the DST string and the packer in order to cope with the thermal expansion caused by the warm fluids and contraction caused by the cold fluids.

Dynamic seals are less robust and may be damaged relatively easily compared to static seals. Thus, despite the fact they are able to provide the flexibility to cope with string movement, they are inherently less reliable and there is a greater risk of leak paths being created.

An advantage of the present invention is that, in the event of failure of the dynamic seal 122, the valve 130 below the packer element 120 would isolate the dynamic seal 122 whereas a valve 140 above the dynamic seal 122 would not. The fluid flow is stopped before it reaches the dynamic seal 122, thereby isolating a more likely leak path.

In alternative embodiments, the control system 146 is located in the instrument carrier 160. In a production well this also has the advantage of allowing the well below the packer to be isolated and controlled without having to kill the well before retrieving the packer seals and upper tubular 118 out of the well.

Figure 4A:
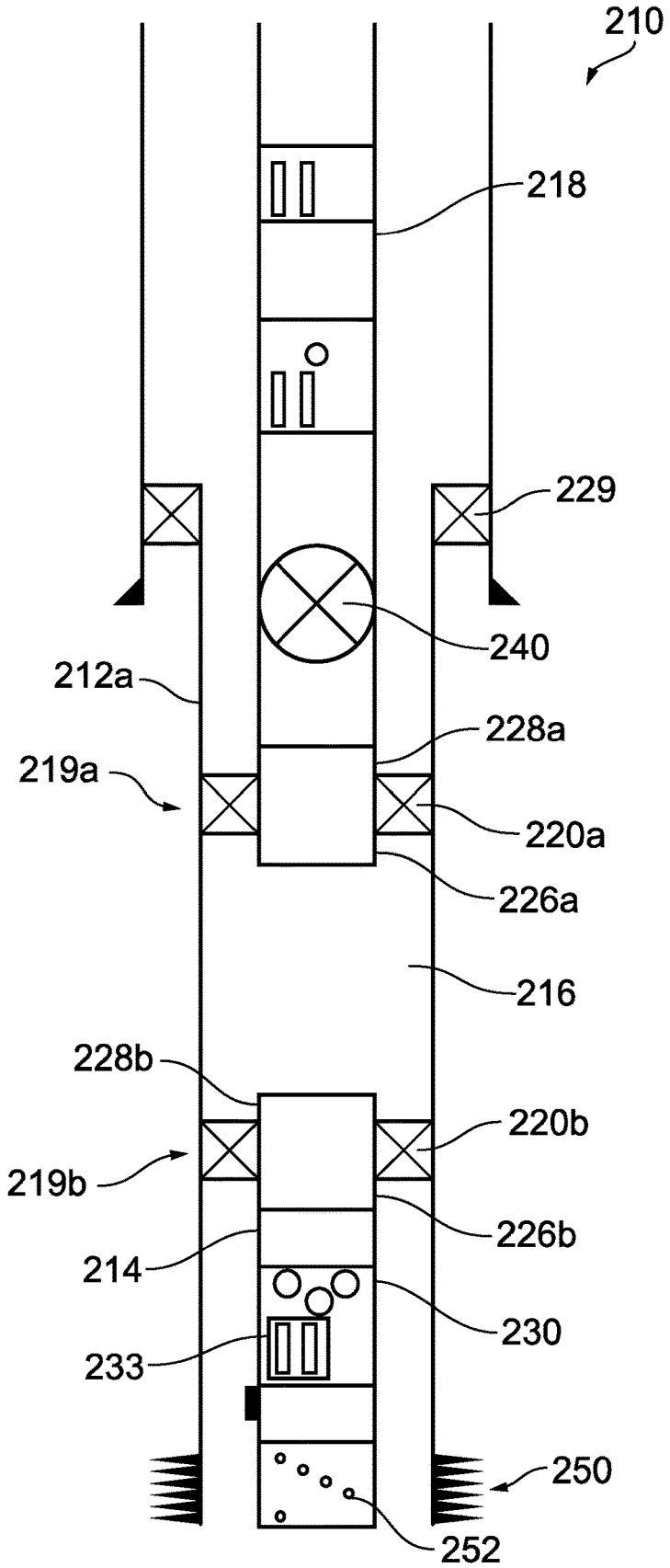

FIG. 4*a* shows a further embodiment of the present invention. Where the features are the same as previous embodiments, they have been labelled with the same number except preceded by a '2'. These features will not be described in detail again here.

This embodiment comprises a well 216 with well apparatus 210 which comprises an upper packer 219*a* and a lower packer 219*b*, both below the tester valve 240.

The upper packer 219*a* comprises an upper packer element 220*a*, a packer lower tubular 226*a* and a packer upper tubular 228*a*. The lower packer 219*b* comprises a lower packer element 220*b*, a packer lower tubular 226*b* and a packer upper tubular 228*b*.

In the present embodiment, the upper packer 219*a* is a temporary/retrievable packer, whereas the lower packer 219*b* is a permanent packer.

The well apparatus 210 also comprises a liner hanger 229 which is part of a liner hanger assembly from which the casing liner 212*a* can be hung.

The upper tubular 218 and lower tubular 214 are not continuous, resulting in a gap between the upper tubular 218 and the lower tubular 214. A wireless relay (not shown) may be provided in the gap between the upper tubular 218 and the lower tubular 214 in order to relay data. The valve 230 is still provided below the upper packer 219*a* along with the electronic control mechanism 233, albeit not in contact therewith.

An advantage of having such an embodiment is that it may reduce the amount, and hence cost, of tubing in the well. In some embodiments, the distance between the upper tubular 218 and the lower tubular 214 could be several hundred feet long to several thousand feet long.

In further embodiments, flowpath(s) such as perforations may be present in the casing and adjacent formation between the upper packer and the lower packer. The flowpath(s) may be created at any time after the drilling and completion of the well. In alternative embodiments, the upper tubular and lower tubular are continuous.

In other embodiments, the upper packer may be a permanent packer and the lower packer may be a temporary/retrievable packer. In further embodiments, both the upper and the lower packers may be temporary/retrievable packers, or they may both be permanent packers.

Figure 4B:
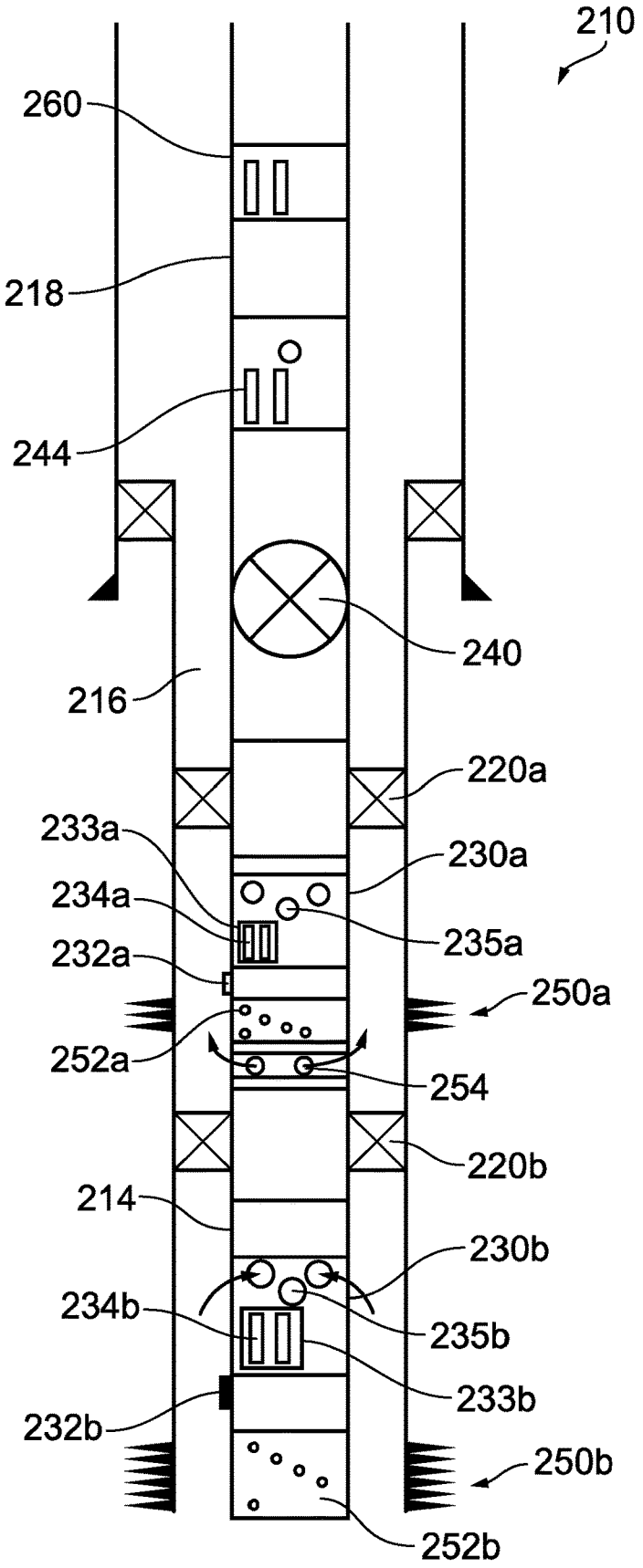

FIG. 4*b* shows a similar well to FIG. 4*a* and where the features are the same they have the same numbering. Compared to FIG. 4*a*, FIG. 4*b* comprises an upper shut-off valve 230*a*, an upper perforating gun 252*a* and flow-ports 254 between an upper packer element 220*a* and a lower packer element 220*b*. Below the lower packer element 220*b* there is a lower shut-off valve 230*b* and a lower perforating gun 252*b* equivalent to the shut-off valve 230 and perforating gun 252 of the FIG. 4*a* embodiment.

Thus this embodiment comprises a multi-zone well 216 with well apparatus 210 which comprises the two packer elements 220*a*, 220*b* below the tester valve 240 which splits the well into two sections. The first section comprises the upper packer element 220*a*, the upper shut-off valve 230*a*, an upper receiver 234*a*, an upper sensing module 232*a*, the upper perforating gun 252*a*, upper perforations 250*a* and flow-ports 254. An electronic control mechanism 233*a* comprises the upper receiver 234*a*. The upper receiver 234*a* is coupled to the upper shut-off valve 230*a*. The second section comprises the lower packer element 220*b*, the lower shut-off valve 230*b*, a lower receiver 234*b*, a lower sensing module 232*b*, the lower perforating gun 252*b* and lower perforations 250*b*. An electronic control mechanism 233*b* comprises the lower receiver 234*b*. The lower receiver 234*b* is coupled to the lower shut-off valve 230*b*.

The upper tubular 218 and lower tubular 214 are continuous and connected via the upper packer element 220*a* and the lower packer element 220*b*. The upper packer element 220*a* is part of a temporary/retrievable packer, whereas the lower packer element 220*b* is part of a permanent packer.

The flow-ports 254 are located above lower packer element 220*b* and the lower shut-off valve 230*b* is located below the lower packer element 220*b*. An advantage of such embodiments is that the lower shut-off valve 230*b* remains to shut in the well if the upper packer is pulled out of the well.

In use during a well-test, when a valve is in a default-close i.e. a well-test mode, this means that a pressure loss in the A-annulus above the valve 220*a* will cause the valve to close. Normally only one of the two shut-off valves 230*a*, 230*b* will be in well-test mode. At the beginning of a well-test sequence, the upper perforations 250*a* are not present. The sequence begins with the upper shut-off valve 230*a* being locked open and the lower shut-off valve 230*b* being switched to well-test mode. The well 216 is then allowed to flow through the lower perforations 250*b* and into the lower tubular 214 via ports 235*b* in the lower shut-off valve 230*b*. The flow then continues through the lower tubular 214 towards flow-ports 254 where it exits the lower tubular 214 and enters the well 216. The flow then enters the lower tubular 214 via ports 235*a* in the upper shut-off valve 230*a* before continuing via the tester valve 240 and upper tubular 218 towards the surface. After a period of time, the lower shut-off valve 230*b* is closed and then the upper perforating gun 252*a* creates upper perforations 250*a*. The upper shut-off valve 230*a* is then switched to well-test mode and the well 216 is allowed to flow via the upper perforations 250*a*. The flow then continues via the ports 235*a* upwards.

The transmitter 244 sends an intermittent signal to the upper receiver 234*a* which in turn instructs the upper shut-off valve 230*a* to stay open. In some embodiments, the signal instructing the upper shut-off valve 230*a* to stay open is relayed via transceivers spaced apart in the well, for example on the instrument carrier 260, the transmitter 244 and the upper shut-off valve 230*a*.

In some embodiments, the lower shut-off valve 230*b* is configured to be controlled via signals from a surface controller at the surface. In further embodiments, the upper shut-off valve 230*a* is permanently in well-test mode and the lower shut-off valve 230*b* is a normal shut-off valve. An advantage of the upper shut-off valve 230*a* being permanently in well-test mode is that it can provide closure for all zones in the multi-zone well.

Such multi-zone wells with multiple valves which can close when the A-annulus (or any annuli if set up for a specific or multiple annuli) loses pressure are much more effective at inhibiting leaks than conventional wells with only one valve, since there are more barriers, and lower in the well, to isolate potential leak paths.

In some embodiments, any combination of temporary/retrievable packers and permanent packers is permitted.

In other embodiments, the locations of the flow-ports 254 (reference numerals for this embodiment relate to the equivalent feature in the FIG. 4*b* embodiment) and the lower shut-off valve 230*b* are interchanged. Thus whilst the lower shut-off valve 230*b* is above the lower packer 220*b*, it still controls the lower section through the tubular 214. An advantage of such an arrangement is that the lower shut-off valve can be retrieved when pulling the upper packer out of the well.

In alternative embodiments, the flow from the well 216 is co-mingled, that is produced from multiple zones simultaneously, instead of being produced from each zone sequentially as is described above. In such embodiments, the upper perforations 250*a* and lower perforations 250*b* are present from the beginning of the well-test sequence. The sequence begins with fluid flow into the well 216 via the lower perforations 250*b* and into the well 216 above the packer 220*b* as described above. The fluids then combine with any further fluids entering the well 216 from the formation via the upper perforations 250*a* to form a co-mingled flow. The co-mingled fluids enter the lower tubular 214 via ports 235*a* in the upper shut-off valve 230*a*, then continue to flow past the valve 240 and through the upper tubular 218 towards the surface. In such embodiments, the lower shut-off valve 230*b* is locked open and the upper shut-off valve 230*a* is in a default-close (fail-safe) well-test mode. Alternatively, both the upper shut-off valve 230*a* and the lower shut-off valve 230*b* may be in a default close well-test mode.

In other embodiments, instead of creating perforations in the casing, a slotted liner may be provided to create a flowpath between the casing and adjacent formation. In multi-zone wells, slotted liners may be provided in one or more well sections adjacent the zones instead of perforations.

In further embodiments, one of the two shut-off valves may be in well-test mode during a DST test. In some embodiments, the features present in a well-test environment may be incorporated in a production completion well environment.

Thus multi-zone wells may be used for production wells. Fur such embodiments, coded pressure pulses in the annulus can be used to select flow from different valves controlling production from different zones.

In alternative embodiments, polished bores on a casing or on a liner along with associated seals may be used as the annular barrier in place of a packer element.

Figure 5:
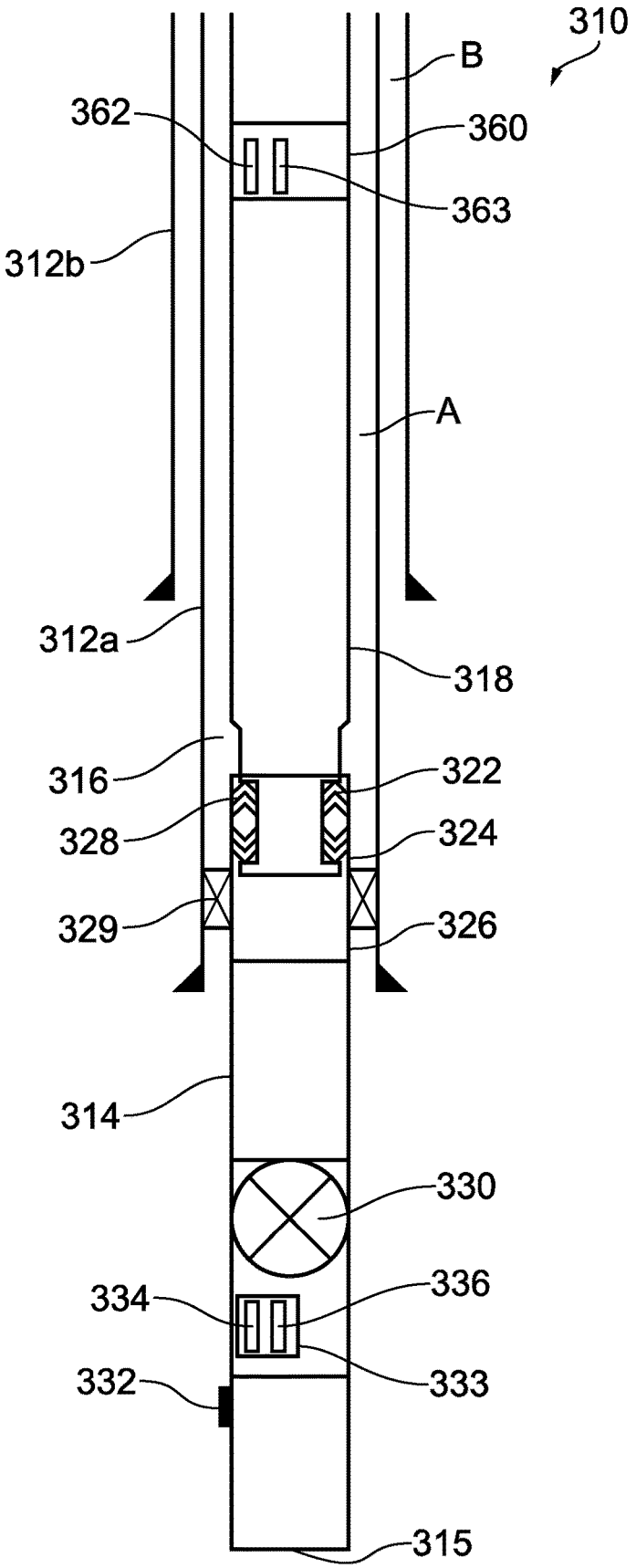
FIG. 5 is a diagrammatic sectional view of a production embodiment in accordance with one aspect of the present invention.

FIG. 5 shows an alternative embodiment of the present invention. Where the features are the same as previous embodiments, they have been labelled with the same number except preceded by a '3'. These features will not be described in detail again here.

This embodiment comprises a production well completion 316 and well apparatus 310 comprising a liner hanger 329. The liner hanger 329 (having a packer element) is part of a liner hanger assembly from which a liner 314 (the lower tubular) can be hung in a casing string 312*a*. The well apparatus 310 also comprises a dynamic seal 322. The dynamic seal 322 is located within a polished bore receptacle 324 above the liner hanger 329. A valve 330 is also provided in the production well 316. An electronic control mechanism 333 comprises a wireless receiver 334 and a programmable control system 336. The wireless receiver 334 is coupled to the valve 330.

The valve 330 may be useful when a production well completion is periodically shut down for maintenance or for other reasons, such as shutting in the well 316. If the well 316 is shut for any reason, the reservoir response can be observed below the valve and this can provide useful information on the reservoir. Embodiments of the invention can thus be used to shut in the well and monitor such behaviour of the reservoir during shut in.

An advantage of shutting in the production well using the valve 330 and not a conventional valve located in the Christmas Tree, is that it reduces the wellbore storage effect, which will in turn improve the quality of data collected from the well.

The characteristic pressure changes set forth in FIGS. 2*a*-2*d* apply equally for this and subsequent embodiments.

A wireless transmitter 362 is located on the upper tubular 318 on an instrument carrier 360, along with a pressure sensor 363. The wireless transmitter 362 would normally transmit a signal less frequently compared to an embodiment of a DST system. For example a signal from the transmitter 362 to the wireless receiver 334 may occur once every hour. This signal may be a "stay closed" signal, and if such a signal is not received, then the valve 330 opens. Thus, in this embodiment of the present invention, the valve 330 can be programmed to bias in the open position in order to maintain the flow of fluids from the well 316 in the event of a communication failure. For example, the valve 330 can be configured to open after a certain period of time, such as two weeks, after it has closed if the receiver 334 does not receive any signals to the contrary.

Thus for such embodiments, the valve 330 and associated components (for example sensors 332) can be used as described above to gain improved data from the well 316. Moreover, there is less danger of inadvertently permanently shutting-off the well 316 because of the counter-intuitive default-open mode.

In some embodiments, a sensor to determine parameters indicative of flow (not shown) is coupled to the valve 330. If the flow is detected to be abnormally high, which would be indicative of an uncontrolled release of fluids from the well 316, then the programmable control system 336 coupled to the valve 330 can instruct the valve 330 to close.

An advantage of configuring the valve to open after a certain period of time is that it not only provides the default-open mode, but it also allows a period of time to, for example, perform maintenance work on the well before it opens. In alternative embodiments, a default-close mode can be employed. In further embodiments, the valve can be configured to alternate between a default open mode and a default close mode, depending on the operational phase the well is in. This is also different to a conventional subsurface safety valve which is configured as a default close valve.

A further advantage of the present embodiment is that it does not increase the safety risk from the well 316, as the valve 330 could or would be provided along with the conventional sub-surface safety valve. In some embodiments, the valve can function as a subsurface safety valve, and switch into a default-close mode. This could occur if the subsurface safety valve fails or manually via communication from the surface.

The valve 330 may also be controlled by a master control signal, in preference to signals from the transmitter 362. For example, after the well 316 has been completed and before it is put into production, remaining work on the well 316 would normally be conducted and a formation saver/isolation valve installed, to prevent well control fluids contacting the formation. For certain embodiments, valves such as the valve 330 may be employed to function as a formation saver valve.

The valve 330 for such an embodiment is preferably retrievable. Moreover, a battery (not shown) may also be retrievable and replaceable optionally with other electronics such as a wireless controller.

Figure 6:
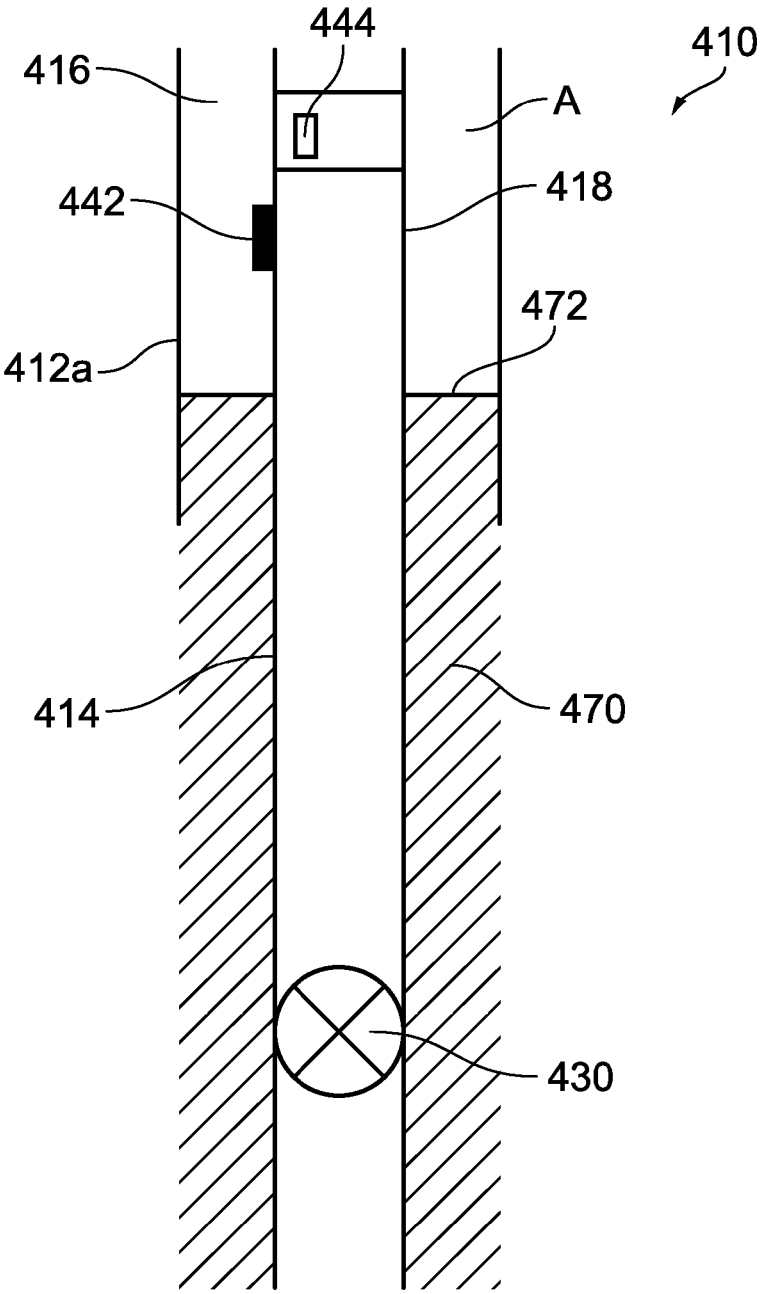
FIG. 6 is a diagrammatic sectional view of a third embodiment of a well and well apparatus comprising a cement seal, in accordance with one aspect of the present invention; and, FIG. 7 is a diagrammatic sectional view of a fourth embodiment of a well and well apparatus comprising a narrowing of the outer casing's inner diameter, in accordance with one aspect of the present invention.

FIG. 6 shows an alternative embodiment of the present invention. Where the features are the same as previous embodiments, they have been labelled with the same number except preceded by a '4'. These features will not be described in detail again here.

In previous embodiments, a shut-off valve was provided below an annular barrier in the form of a packer element. This embodiment comprises a well 416 and well apparatus 410 wherein the annular barrier is a top 472 of a cemented-in portion 470 located in the A-annulus.

A valve 430 is located within a lower tubular 414 below the top 472 of the cemented-in portion 470.

The well apparatus 410 further comprises a pressure sensor 442 located in the A-annulus above the top 472 of the cemented-in portion 470. An upper tubular 418 is located above the top 472 of the cemented-in portion 470. A lower tubular 414 is located below the top 472 of the cemented-in portion 470.

In addition, or as an alternative, to the failsafe functionality of previous embodiments, this embodiment utilises pressure key sequencing providing a characteristic change in pressure which is detected by the pressure sensor 442, and coupled to a wireless transmitter 444 to control the valve 430 below the annular barrier/top 472 of the cemented in portion 470.

In alternative embodiments, the cemented-in portion may not extend all of the way down the well and so has a lower end. In such embodiments, the shut-off valve may be located below the lower end of the cemented-in portion.

Figure 7:
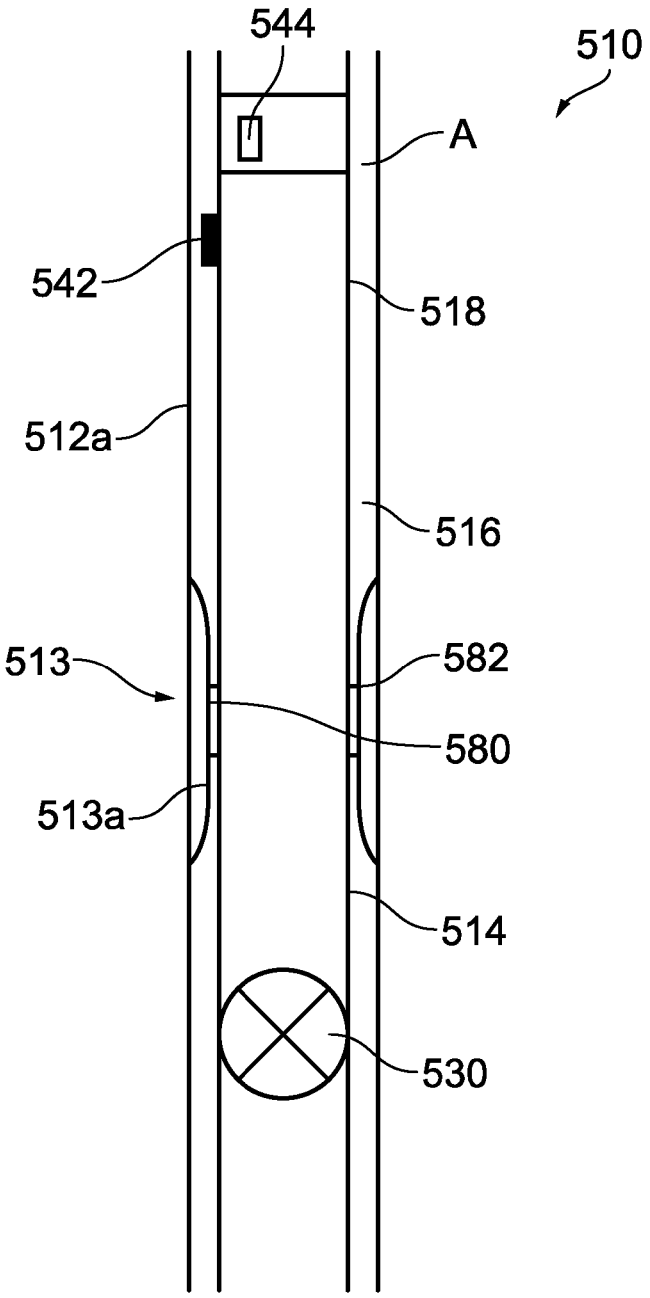

FIG. 7 shows an alternative embodiment of the present invention. Where the features are the same as previous embodiments, they have been labelled with the same number except preceded by a '5'. These features will not be described in detail again here.

This embodiment comprises a well 516 and well apparatus 510 comprising a 7 inch outer diameter outer casing 512*a* having a polished bore 580 at a lower portion 513*a* to receive a maximum 5 ½ inch outer diameter tubulars 514, 518 and seals 582. The upper tubular 518 and the lower tubular 514 are continuous.

A variety of other tubular sizes may be used.

An advantage of using a polished bore within a casing is that the diameter of the borehole through the annular barrier is reduced by around a quarter of an inch, compared to using a permanent packer where the diameter of the borehole through the packer is normally reduced by two or more inches. It is thus easier to run equipment past casing with a polished bore compared to through a packer.

The inner diameter of the outer casing 512*a* reduces at a sub 513 which has a reduced diameter polished bore on its inner surface 513*a*. Seals 582 are located between the 5.5 inch diameter tubulars 514, 518 and the lower portion 513*a* of the outer casing 512*a*. An annular barrier is effectively formed by the reduction in the inner diameter of the sub 513 and the seals 582.

A valve 530 is located below the seals 582.

In the FIG. 7 embodiment, the valve 530 is below the polished bore 580 rather than below the top of the cemented-in portion.

An advantage of the FIG. 6 and FIG. 7 embodiments is that a valve can be remotely controlled using pressure pulses in the A-annulus.

In an alternative embodiment, the reduction in casing inner diameter could extend to an end of the casing string. In any case, the section of narrower casing diameter and associated seals still provides an annular barrier. This could also be useful on a monobore production completion as any potential internal restriction is at the end of the casing.

Improvements and modifications may be made without departing from the scope of the invention. In the embodiments described above a number of pressure sensors may be provided, spaced apart above the packer element at different distances, coupled to a transmitter/transmitters. This provides redundancy should lower pressure sensors not receive a signal, for example, because of a heavy mud suspension settling out.

In some embodiments, in response to control signals, the shut-off valve can take up intermediate position(s) between a fully open and a fully closed position. In use, this chokes the flow of fluid therethrough. Whilst in such positions, the valve can still continue to receive signals for opening or shutting if there is a characteristic change in pressure in an annulus.

In further embodiments, data and/or control signals may be relayed between several locations above a packer element wirelessly and/or using wires and between several locations below a packer element wirelessly and/or using wires. Furthermore, in some embodiments the transmitter and receiver have transceiver capabilities. Alternatively, instead of having a separate transmitter and receiver, one device with transceiver capabilities may be provided.

Whilst illustrated embodiments show single strings and single bore completions, embodiments may be used with multiple string (for example dual completion wells) or multi-lateral wells. The wells could be horizontal or deviated and references to for example "lower" etc. are equally applicable to horizontal wells and in such a context, means further from the well surface.

The invention claimed is:

1. A well comprising:

a borehole with an upper tubular and a lower tubular therein, each tubular having a longitudinal bore; and a well apparatus, the well apparatus comprising:

an annular barrier provided between one of the borehole and a casing within the borehole, and one of the upper and lower tubulars, such that the upper tubular extends from and above the annular barrier such that an annular space above the annular barrier is provided between the upper tubular and the borehole, and the lower tubular is provided in the borehole below the annular barrier; a pressure activated device at most 100m above the annular barrier, and exposed to pressure in said annular space between the upper tubular and the borehole, and adapted to detect a characteristic change in pressure;

an electronic transmitter above the annular barrier and communicatively coupled in the well to the pressure activated device, and configured to transmit a control signal;

a flowpath through at least one of the longitudinal bore of the lower tubular and a port in the lower tubular;

a valve connected to the lower tubular, the valve configured to one of allow and resist flow of fluids through said flowpath;

an electronic control mechanism below the annular barrier to control the valve, the electronic control mechanism comprising an electronic communication device with a receiver configured to receive the control signal from the electronic transmitter for operating the valve;

a circulating valve located in the upper tubular and adapted to do one of allow and resist flow of fluids between the longitudinal bore of the upper tubular and at least a portion of the annular space, wherein the pressure activated device is communicatively coupled in the well to the circulating valve physically, and/or via at least one of electromagnetic and acoustic transmission, and wherein the valve connected to the lower tubular and the circulating valve are interlocked such that they are not permitted to be in an allow-flow position at the same time;

wherein the electronic transmitter and the receiver comprise one of:

an acoustic transmitter and an acoustic receiver; and, an electromagnetic transmitter and an electromagnetic receiver wherein said one of the acoustic transmitter and electromagnetic transmitter is configured to perform at least one of:

(a) sending a signal; and, (b) stop sending a default signal, to said one of the acoustic receiver and electromagnetic receiver respectively, in response to the pressure-activated device detecting a characteristic change in pressure.

2. A well as claimed in claim 1, wherein the characteristic change in pressure comprises a drop in pressure.

3. A well as claimed in claim 1, wherein the valve is adapted to move to one of allow and resist flow through the flowpath within 5 minutes after the characteristic change in pressure.

4. A well as claimed in claim 1, wherein in a closing mode, the electronic transmitter is configured to send a signal to instruct the valve to resist flow of fluids through said flowpath when the pressure activated device detects the characteristic change in pressure.

5. A well as claimed in claim 1, wherein in an opening mode, the electronic transmitter is configured to send a signal to instruct the valve to allow flow of fluids through said flowpath when the pressure activated device detects the characteristic change in pressure.

6. A well as claimed in claim 1, wherein the transmitter is configurable to periodically send a default signal to the receiver, unless a characteristic change in pressure is detected, wherein in a default mode, and in the absence of the receiver receiving said periodic default signal for a specified period of time, a component of the well apparatus is programmed to bias the valve to one of resist flow and allow flow through the flowpath.

7. A well as claimed in claim 6, wherein in a default-close mode and in the absence of the receiver receiving said default signal for a specified period of time, the valve is biased to resist flow of fluids through said flowpath.

8. A well as claimed in claim 7, wherein in the default-close mode, the transmitter is configured to periodically send an 'allow flow' signal to the receiver; and when the pressure activated device detects the characteristic change in pressure, it is configured to stop sending said 'allow flow' signal.

9. A well as claimed in claim 6, wherein in a default-open mode, the transmitter is configured to periodically send a 'resist flow' signal to the receiver; and when the pressure activated device detects the characteristic change in pressure, it is configured to stop sending said 'resist flow' signal.

10. A well as claimed in claim 6, wherein at least one further electronic transmitter is provided below the annular barrier configured to send information to above the annular barrier.

11. A well as claimed in claim 10, further comprising at least one sensor below the annular barrier exposed to conditions below the annular barrier on a lower side of the flowpath, wherein the at least one sensor comprises at least one of a pressure sensor, temperature sensor, flow sensor and position sensor, and wherein the further electronic transmitter is configured to send at least one of information regarding the status of the valve and information from the at least one sensor, to above the annular barrier.

12. A well as claimed in claim 10, wherein the further electronic transmitter is configured to send the information to above the annular barrier simultaneously with the transmitter sending a default signal to the receiver.

13. A well as claimed in claim 1, wherein the valve is operable as a downhole flow control valve in a drill stem test apparatus.

14. A well as claimed in claim 1 which is a one of a production well and an injection well.

15. A well as claimed in claim 14, wherein the apparatus comprises at least one device which monitors parameters which are indicative of flow rate through the valve, and wherein the valve is adapted to resist flow of fluids if the at least one device monitors that a pre-determined flow rate is exceeded.

16. A well as claimed in claim 1, wherein the pressure acting on the pressure activated device is controllable from outwith the well.

17. A well as claimed in claim 1, wherein the pressure activated device comprises a pressure sensor.

18. A well as claimed in claim 1, wherein the upper tubular is the innermost tubular of adjacent tubulars in the well.

19. A well as claimed in claim 1, wherein the valve is retro-fitted.

20. A well as claimed in claim 1, wherein the valve can take up a plurality of intermediate allow-flow positions in order to provide choke functionality in at least one of said intermediate positions.

21. A well as claimed in claim 1, wherein the annular barrier comprises a packer element.

22. A well as claimed in claim 1, wherein the pressure activated device is at most 50m above the annular barrier.

23. A well as claimed in claim 1, comprising a further flowpath through at least one of the longitudinal bore of the lower tubular and a port in the lower tubular;

and a further valve connected to the lower tubular, the further valve configured to one of allow and resist flow of fluids through said further flowpath.

24. A method to conduct a drill stem test (DST) on the well as claimed in claim 1, comprising:

providing the well apparatus in the well;

conducting the drill stem test;

wherein after conducting the drill stem test, the upper tubular is removed from the well, whilst the lower tubular and the valve remain in the well.

25. A well as claimed in claim 1, wherein the electronic transmitter is directly coupled to the pressure activated device within the well.

26. A well comprising:

a borehole with an upper tubular and a lower tubular therein, each tubular having a longitudinal bore; and a well apparatus, the well apparatus comprising:

an annular barrier provided between one of the borehole and a casing within the borehole, and one of the upper and lower tubulars, such that the upper tubular extends from and above the annular barrier such that an annular space above the annular barrier is provided between the upper tubular and the borehole, and the lower tubular is provided in the borehole below the annular barrier;

a pressure activated device at most 100m above the annular barrier, and exposed to pressure in said annular space between the upper tubular and the borehole, and adapted to detect a characteristic change in pressure;

an electronic transmitter above the annular barrier and communicatively coupled within the well to the pressure activated device, and configured to automatically transmit a control signal in response to detection of the characteristic change in pressure by the pressure activated device;

a flowpath through at least one of the longitudinal bore of the lower tubular and a port in the lower tubular;

a valve connected to the lower tubular, the valve configured to one of allow and resist flow of fluids through said flowpath;

a circulating valve located in the upper tubular and adapted to do one of allow and resist flow of fluids between the longitudinal bore of the upper tubular and at least a portion of the annular space, wherein the pressure activated device is communicatively coupled in the well to the circulating valve physically, and/or via at least one of electromagnetic and acoustic transmission, and wherein the valve connected to the lower tubular and the circulating valve are interlocked such that they are not permitted to be in an allow-flow position at the same time;

an electronic control mechanism below the annular barrier to control the valve, the electronic control mechanism comprising an electronic communication device with a receiver configured to receive the control signal from the electronic transmitter for operating the valve, the control signal comprising an instruction for the valve to resist flow based on detection of the characteristic change in pressure;

wherein the electronic transmitter and the receiver comprise one of:

an acoustic transmitter and receiver; and, an electromagnetic transmitter and receiver.

27. A well as claimed in claim 26, wherein the electronic transmitter is configured to send a default signal prior to detection of the characteristic change in pressure, and wherein the default signal comprises an instruction for the valve to allow flow of fluids through the flowpath.

* * * * *